US012188220B2

(12) United States Patent
Ledoux et al.

(10) Patent No.: US 12,188,220 B2
(45) Date of Patent: Jan. 7, 2025

(54) SELF-STORAGE FACILITY, FABRICATION, AND METHODOLOGY

(71) Applicant: GS LICENSECO LLC, Raleigh, NC (US)

(72) Inventors: David Wayne Ledoux, Houston, TX (US); Richard Waldon Stockton, Jr., Houston, TX (US)

(73) Assignee: GS LICENSECO LLC, Raleigh, NC (US)

( * ) Notice: Subject to any disclaimer, the term of this patent is extended or adjusted under 35 U.S.C. 154(b) by 218 days.

(21) Appl. No.: 17/761,583

(22) PCT Filed: Sep. 18, 2020

(86) PCT No.: PCT/US2020/051602
§ 371 (c)(1),
(2) Date: Mar. 17, 2022

(87) PCT Pub. No.: WO2021/055829
PCT Pub. Date: Mar. 25, 2021

(65) Prior Publication Data

US 2022/0341156 A1 Oct. 27, 2022

Related U.S. Application Data

(60) Provisional application No. 62/902,347, filed on Sep. 18, 2019.

(51) Int. Cl.
*E04B 1/348* (2006.01)
*E04H 3/00* (2006.01)

(52) U.S. Cl.
CPC ..... *E04B 1/34861* (2013.01); *E04B 1/3483* (2013.01); *E04H 3/00* (2013.01)

(58) Field of Classification Search
CPC ..... E04B 1/34861; E04B 1/34807; E04B 1/3483; E04H 3/00; E04H 2001/1283; E04H 1/005
See application file for complete search history.

(56) References Cited

U.S. PATENT DOCUMENTS 3,623,296 A * 11/1971 Santoro ..... E04B 1/34807 D25/4
3,925,679 A * 12/1975 Berman ..... E04B 1/3483 290/1 R (Continued)

*Primary Examiner* — Gisele D Ford
(74) *Attorney, Agent, or Firm* — Fay Kaplun & Marcin, LLP

(57) ABSTRACT

A self-storage facility with a first set of load bearing modular units (LBMUs) aligned along a same first horizontal plane. The first set has a plurality of rows of LBMUs and each LBMU in each row in the plurality of rows of LBMUs is positioned in a side-to-side relationship with another LBMU in a corresponding row in the plurality of rows of LBMUs. Furth, each LBMU in each row in the plurality of rows of LBMUs is positioned in at least one end-to-end relationship with another LBMU in an adjacent row of a plurality of rows of LBMUs. The facility also includes a first passageway through both sidewalls and transverse to a major axis of each LBMU in a majority of the LBMUs in a first row in the plurality of rows of LBMUs, and a second passageway through both sidewalls and transverse to a major axis of each LBMU in a majority of the LBMUs in a second row in the plurality of rows of LBMUs.

19 Claims, 22 Drawing Sheets

(56) References Cited

U.S. PATENT DOCUMENTS 4,059,931 A * 11/1977 Mongan ..... E04C 5/122 52/79.12
4,599,829 A * 7/1986 DiMartino, Sr. ..... E04B 1/3483 52/106
8,484,929 B1 * 7/2013 Begdouri ..... B65D 88/76 52/745.03
8,991,134 B2 * 3/2015 Wheeler ..... E04B 1/343 220/4.27
10,280,608 B2 * 5/2019 Ledoux ..... B65D 88/022
11,001,187 B1 * 5/2021 Kelly ..... B60P 3/32
2005/0055939 A1 * 3/2005 Wolgemuth ..... E04H 14/00 52/506.01
2007/0271857 A1 * 11/2007 Heather ..... B65D 90/006 52/79.9
2008/0250726 A1 * 10/2008 Slagel ..... E04H 1/1205 52/79.8
2011/0016801 A1 * 1/2011 Ziegelman ..... E04H 1/005 52/79.9
2011/0056147 A1 * 3/2011 Beaudet ..... E04B 1/34869 52/79.9
2011/0173907 A1 * 7/2011 Katsalidis ..... E04C 3/30 52/741.1
2013/0067832 A1 * 3/2013 Collins ..... E04B 1/24 52/125.1
2015/0240475 A1 * 8/2015 Malakauskas ..... E04H 1/04 52/79.13
2015/0266616 A1 * 9/2015 Barrable ..... B65D 90/0006 403/267
2016/0010883 A1 * 1/2016 Jornitz ..... F24F 3/167 29/897.3
2016/0130795 A1 * 5/2016 Downey ..... E04H 1/005 52/745.02
2016/0137404 A1 * 5/2016 Steiner ..... B61D 9/14 220/1.5
2017/0167128 A1 * 6/2017 Bouveng ..... E04H 1/005
2017/0198489 A1 * 7/2017 Klein ..... E04B 1/34384
2017/0199505 A1 * 7/2017 Harper ..... E04H 5/02
2018/0106030 A1 * 4/2018 Ledoux ..... B65D 90/0006
2018/0109163 A1 * 4/2018 Paine ..... E04H 5/04
2018/0283036 A1 * 10/2018 Davis ..... B65G 1/0464
2019/0024364 A1 * 1/2019 Lestini ..... E04H 1/04
2019/0100934 A1 * 4/2019 Ansari ..... E04H 5/02
2019/0119903 A1 * 4/2019 Rebeil ..... E04B 1/34352
2019/0145118 A1 * 5/2019 Gauthier ..... E04H 1/125 52/79.1
2019/0257073 A1 * 8/2019 Ledoux ..... B65D 90/008
2019/0277016 A1 * 9/2019 Ahern ..... E04B 1/1912
2019/0277020 A1 * 9/2019 Ahern ..... F24F 7/065
2020/0040594 A1 * 2/2020 Hedberg ..... E04H 1/005

* cited by examiner

LEGEND

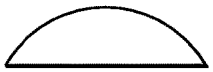

= CONTAINER DOORS TO BE REMOVED

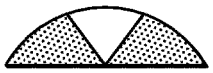

= CONTAINER DOORS TO BE WELDED SHUT (MIN 1" WELD AT CENTER TOP AND BOTTOM, AND 3 TACK WELDS EQUALLY SPACED BETWEEN DOORS)

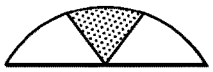

= CONTAINER DOORS TO REMAIN OPERABLE

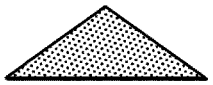

= CONTAINER END PANEL TO BE REMOVED (POSTS AND BEAMS TO REMAIN)

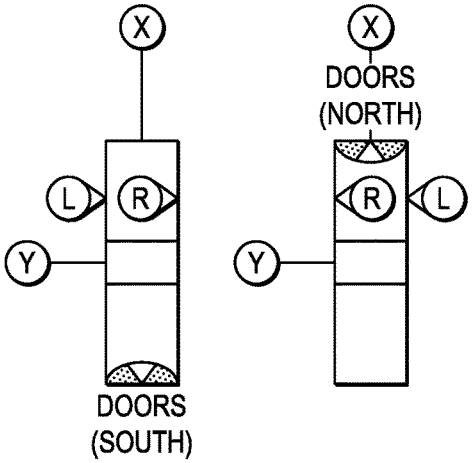

= CONTAINER DESIGNATION FOR SEQUENCING:

X=COLUMN (SEE GRIDLINE DESIGNATIONS ON PLAN)

Y=ROW (SEE GRIDLINE DESIGNATIONS ON PLAN)

Z=FLOOR (SEE PLAN TITLE FOR FLOOR DESIGNATION)

L=SEE ELEVATION ON SI-610 AND SI-611 FOR REQUIRED CONTAINER CORRIDOR CUTS ON LEFT WALL

R=SEE ELEVATION ON SI-610 AND SI-611 FOR REQUIRED CONTAINER CORRIDOR CUTS ON RIGHT WALL

NOTE: LEFT AND RIGHT SIDES ARE ALWAYS DEFINED IN RELATION TO THE DOOR OF THE CONTAINER AS SHOWN IN THE ILLUSTRATION. IN THE SEQUENCING PLAN THE DOORS ARE ORIENTED PLAN NORTH OR SOUTH DEPENDING ON THE REQUIRED LOCATION FOR BUILDING CONSTRUCTION, AND THE LEFT AND RIGHT DESIGNATION WILL FLIP ACCORDINGLY.

FIG. 19

FIG. 23A

| LIGHTING FIXTURE SCHEDULE | | | | |
|---|---|---|---|---|
| TYPE | LAMP | VAPER FIXTURE | DESCRIPTION | CATALOG NUMBER |
| A | INTEGRAL LED | 28.3 VA | LED 4' STRIP LIGHT LUMINAIRE HANG FIXTURES AT 9'-0" AFF. MOUNT FIXTURES WITH GRIPLOCK 10' HANGING KITS. FOR MOUNTING ELEVATIONS, COORDINATE WITH ARCHITECTURAL SHEETS FOR ADDITIONAL ELEVATION INFORMATION, COORDINATE COLOR WITH OWNER PRIOR TO ORDERING | LITHONIA LIGHTING-CDS-L48-MVOLT-40K-WH |
| B | INTEGRAL LED | 32.0 VA | LED WALL PACK WITH INTEGRAL PHOTOCELL. MOUNT FIXTURES AT 8'-6'. FOR MOUNTING ELEVATIONS, COORDINATE WITH ARCHITECTURAL SHEETS FOR ADDITIONAL ELEVATION INFORMATION. COORDINATE COLOR INFORMATION WITH OWNER PRIOR TO ORDERING | COOPER LIGHTING-WKP-48LED-E-2-GL-AP-5 |
| C | INTEGRAL LED | 59.0 VA | LED WALL PACK. 4000K, 70 CRI | MCGRAW EDISON-GWC-AF-01-LED-E1-T4FT |
| D | INTEGRAL LED | 20.0 VA | HIGH IMPACT 12" X 12" X 4-7/8" DEEP, EDGE LIT LED WALL PACK WITH INTEGRAL OCCUPANCY, SENSOR AND EMERGENCY BATTERY BACK-UP. MOUNT FIXTURES AT 8'-0" AFF. | FAIL-SAFE-FW-LED2-1212-2000-3500K-UNV-CP-R4-EDD1-LGW-EL7W-OS |
| E | INTEGRAL LED | 20.0 VA | TBD | TBD |

TO FIG. 23B

FROM FIG. 23A

FIG. 23B

| | | | | |
|---|---|---|---|---|
| EX | LED | 1.0 VA | LED EXIT SIGN MOUNTED TO CEILING. COORDINATE CHEVRON DIRECTIONS WITH DRAWINGS AND EGRESS PATHS. SEE ARCHITECTURAL SHEETS FOR ADDITIONAL INFORMATION COORDINATE LETTER COLOR WITH OWNER PRIOR TO ORDERING | COOPER LIGHTING-APX6-R |
| EXA | LED | 2.0 VA | LED EXIT SIGN WITH DUAL HEADS MOUNTED TO CEILING. COORDINATE CHEVRON DIRECTIONS WITH DRAWINGS AND EGRESS PATHS. SEE ARCHITECTURAL SHEETS FOR ADDITIONAL INFORMATION. COORDINATE LETTER COLOR WITH OWNER PRIOR TO ORDERING | COOPER LIGHTING-APC7-R |
| EXR | LED | 1.0 VA | LED DUAL REMOTE HEAD WITH BATTERY FOR EGRESS LIGHTING, MOUNTED TO CEILING | COOPER LIGHTING-AP2SQLED |
| G1 | LED | 1.3 VA | 120V LED TAPE LIGHT (1) 65' SPOOL, COOL WHITE, 60 LEDS/M, MAX RUN 330', DIMMABLE, 126 LUMENS/FT | BRILLIANT - STRIP 12035-20-CW |
| G2 | LED | 1.3 VA | 120V LED TAPE LIGHT (2) 65' SPOOL, COOL WHITE, 60 LEDS/M, MAX RUN 330', DIMMABLE, 126 LUMENS/FT | BRILLIANT - STRIP 12035-20-CW |
| G3 | LED | 1.3 VA | 120V LED TAPE LIGHT (1) 148' SPOOL, COOL WHITE, 60 LEDS/M, MAX RUN 330', DIMMABLE, 126 LUMENS/FT | BRILLIANT - STRIP 12035-45-CW |
| G4 | LED | 1.3 VA | 120V LED TAPE LIGHT (1) 65' SPOOL (1) 148' SPOOL, COOL WHITE, 60 LEDS/M, MAX RUN 330', DIMMABLE, 126 LUMENS/FT | BRILLIANT - STRIP 12035-20-CW, BRILLIANT - STRIP 12035-45-CW |
| G5 | LED | 1.3 VA | 120V LED TAPE LIGHT (2) 148' SPOOL, COOL WHITE, 60 LEDS/M, MAX RUN 330', DIMMABLE, 126 LUMENS/FT | BRILLIANT - STRIP 12035-45-CW |
| RH | LED | 3.0 VA | TWIN LIGHT REMOTE HEADS | LITHONIA: ELA-T-Q-L0304-SD |

SELF-STORAGE FACILITY, FABRICATION, AND METHODOLOGY

TECHNICAL FIELD

The preferred embodiments relate to self-storage facilities.

BACKGROUND ART

Self-storage facilities are prolific and include a number of associated storage units located at a single location, which may be indoor, outdoor, or a combination thereof and also may or may not include climate control. A typical facility rents or leases individual storage units, which may vary in size, configuration, and are often priced accordingly. Such facilities provide various benefits to various people, typically consumers and commercial business in the general public. For example, an owner/renter/lessee of a unit is able to store and retrieve various items within their unit and access them over typically flexible times during the period of the agreement, subject to any additional limitations of the agreement. As another example, self-storage units provide additional storage flexibility to the user as they are able to store additional goods without a need to sell or otherwise lose access to such goods, while still supplementing whatever storage they have at their place of residence or business. Thus, keepsakes, valuables, hobby items, personal belongings, surplus items and equipment, inventory, and the like all may be retained without adding cost that might be associated with needing a larger place of residence or business.

While the above is well-established and has served both facility owners and users, existing single level and multi-level self-storage facilities can be expensive to design and build, and such costs may be passed on to consumers, developers, and investors. For decades, advances in the industry had been fairly slow in the industry, for example with various areas such as the development of technology, intellectual property, and manners of improving the business both to the consumer as well as the owners and investors that develop, own, and maintain such facilities.

The present inventors have heretofore recognized the above drawbacks as well as others. In this regard, the inventors have developed various improvements in this realm. For example, the inventors identified in U.S. Pat. No. 10,280,608, titled "Self-Storage Facility, Fabrication, and Methodology," issued May 7, 2019 to Ledoux et al., various improvements, which are therein described and claimed. Indeed, facilities having tens of thousands of self-storage square footage space have now been constructed according to certain aspects in that U.S. Patent, and consumers are responding favorably with the rental of spaces therein.

With the present inventors having recognized drawbacks of the prior art, and having further improved on the prior art both in U.S. Pat. No. 10,280,608, and having further endeavored the time, coordination, study, effort, and additional resources in the construction of actual facilities, the inventors now contemplate additional preferred embodiments as further improvements to the above. Such preferred embodiments are described below.

DISCLOSURE OF INVENTION

In one embodiment, there is a self-storage facility with a first set of load bearing modular units (LBMUs) aligned along a same first horizontal plane. The first set has a plurality of rows of LBMUs and each LBMU in each row in the plurality of rows of LBMUs is positioned in a side-to-side relationship with another LBMU in a corresponding row in the plurality of rows of LBMUs. Further, each LBMU in each row in the plurality of rows of LBMUs is positioned in at least one end-to-end relationship with another LBMU in an adjacent row of a plurality of rows of LBMUs. The facility also includes a first passageway through both sidewalls and transverse to a major axis of each LBMU in a majority of the LBMUs in a first row in the plurality of rows of LBMUs, and a second passageway through both sidewalls and transverse to a major axis of each LBMU in a majority of the LBMUs in a second row in the plurality of rows of LBMUs.

Numerous other aspects and preferred embodiments are described and claimed.

BRIEF DESCRIPTION OF DRAWINGS

FIG. 2 is the second floor atop the first floor, and FIG. 3 is the third floor atop the second floor.

FIG. 19 illustrates a legend for the LBMU endwall doors of FIGS. 16-18.

FIGS. 23A-23B illustrate a legend for FIGS. 20-22.

approximately centered through an LBMU sidewall and with reduced vertical support structure.

Figure 29:
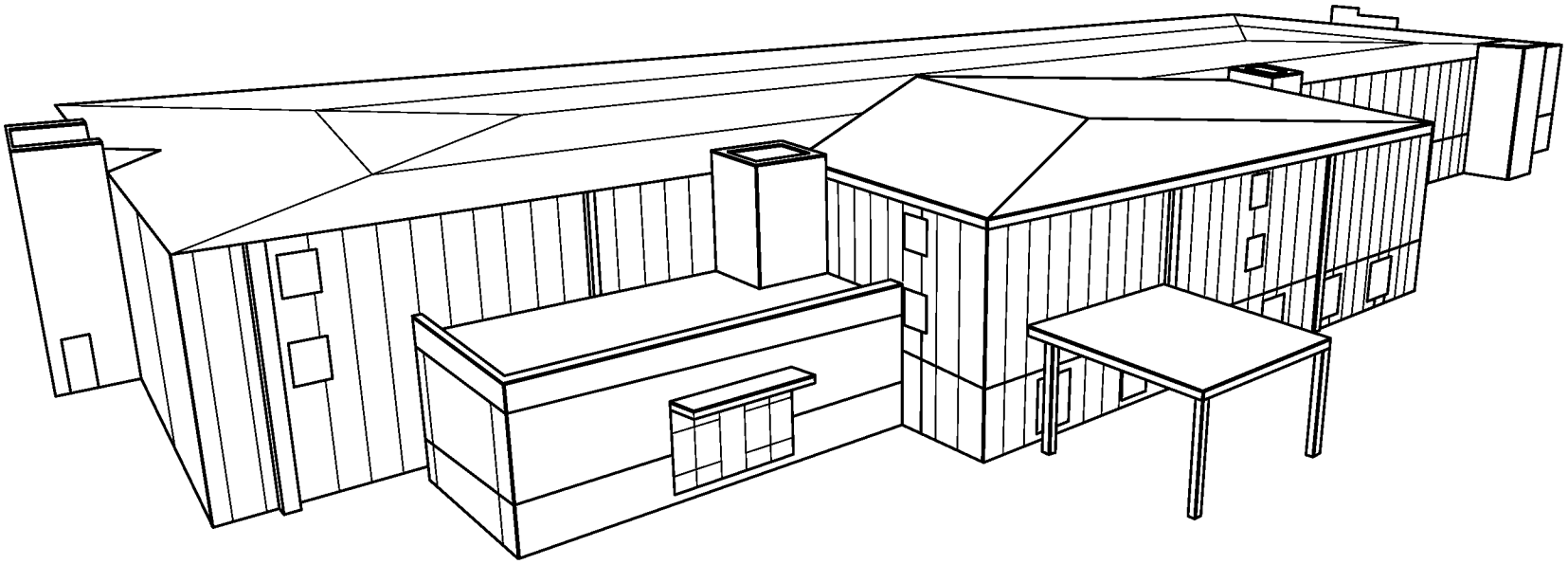

FIG. 29 illustrates a perspective view of a self-storage facility in accordance with teachings herein.

DESCRIPTION OF EMBODIMENTS

Preferred embodiments locate, position, and stack load bearing modular units (LBMU as singular, LBMUs as plural), such as commercial shipping containers, and augment and build upon prior teachings of the present inventors, such as in the above-incorporated U.S. Pat. No. 10,280,608. Those and the present teachings stand to further revolutionize the self-storage industry, for example by reducing not only the costs of construction, but by meaningfully improving the ecological or "green" footprint of such facilities, for example in reducing the use of certain materials and energy during construction and use and preferably repurposing shipping containers (or other LBMUs), such as in a self-storage facility. Other resource usages are also improved by the preferred embodiments, as further described below.

Improvements provided herein include any of the following, either singularly or in combination:

- Ordered stacking of LBMUs across a planar substrate, such as a cement slab, for example stacked with corner blocks touching or within a short distance (e.g., 2" or less) of an adjacent LBMUs in both the horizontal and vertical dimensions, and connecting corners blocks such as with welding
- Hallway/corridors cut and extending transversely across the opposing respective sidewalls (and majority axis) through plural, parallel oriented LBMUs on a same horizontal level. A single corridor through multiple such LBMUs realizes two storage spaces in each traversed container, each storage space on opposing sides of the corridor and in the same LBMU through which the corridor extends.
- Selectively positioned corridors through LBMU sidewalls on vertically adjacent levels to mitigate structural reinforcement augmentation
- Support structure for LBMU sidewall apertures, particularly in multi-level vertical applications
- Selective use of LBMU end doors (e.g., preexisting shipping container doors) as space partitions
- Structural supports between upper LBMU bottom rails and lower LBMU top rails
- Structural supports between lowest level LBMU bottom rails and the underlying substrate (e.g., cement or other planar foundation)
- Selectively positioned lighting, fire sprinklers, and air handling The preferred embodiments also permit the reconfiguration and therefore in part repurposing of shipping containers as storage LBMUs, while the reconfiguration, placement, and related features herein allow certain benefits, including volume, strength, and load bearing, are realized, while at the same time removing dormant, abundant shipping containers from other locations, where such containers may be unsightly or undesired. Moreover, the combinations involved in various preferred embodiments yield an overall further reduction in the cost and reduction in construction schedule as compared to conventionally manufactured self-storage facilities, which savings can be shared among the various parties involved with the facility, including the customers that ultimately rent units within the facility. By way of further introduction, the reader is referred to co-owned PCT patent applications PCT/US16/26406, filed Apr. 7, 2016, and published as WO 2016/164560, and PCT/US17/59397, filed Oct. 31, 2017, both of which are fully hereby incorporated herein by reference. Such applications include, among other things, descriptions and illustrations of various aspects, including shipping containers stacked at multiple levels (or stories) and with access apertures in the sidewalls or endwalls by which a person may gain access to the interior of a shipping container, for purposes of storing/retrieving items therein.

A considerable amount of the discussion and illustration in the above-referenced PCT patent applications are directed to shipping containers with one or more access apertures AA in one side of a shipping container. Each such access aperture AA provides access to a respective storage space inside that container, where the space is bounded by portions of the existing container walls or end, plus a partition wall added into the interior of the shipping container and spanning between the two sidewalls of the shipping container. For example, a single sidewall of a shipping container may have two access apertures cut through it, with a sidewall-to-sidewall spanning partition wall between the two access apertures. For example, for a 40 foot long shipping container, the partition wall can be placed midway between the ends of the shipping container, separating it into two spaces, each 20 foot long and having the shipping container width (e.g., 8 feet). Each of those spaces is accessible by a respective access aperture in the shipping container sidewall, or by an access aperture at the end of the container, either by cutting through the originally-closed end of the container or by using its originally-equipped door (that typically comes on the rear end of such a shipping container). In many instances, each access aperture also has a corresponding roll-up door, aligned to or co-planar with the shipping container sidewall. Such aspects may be included in part in embodiments herein, but some, or a majority, of the facility space described herein is achieved in an alternative configuration, as further detailed below.

Figure 1:
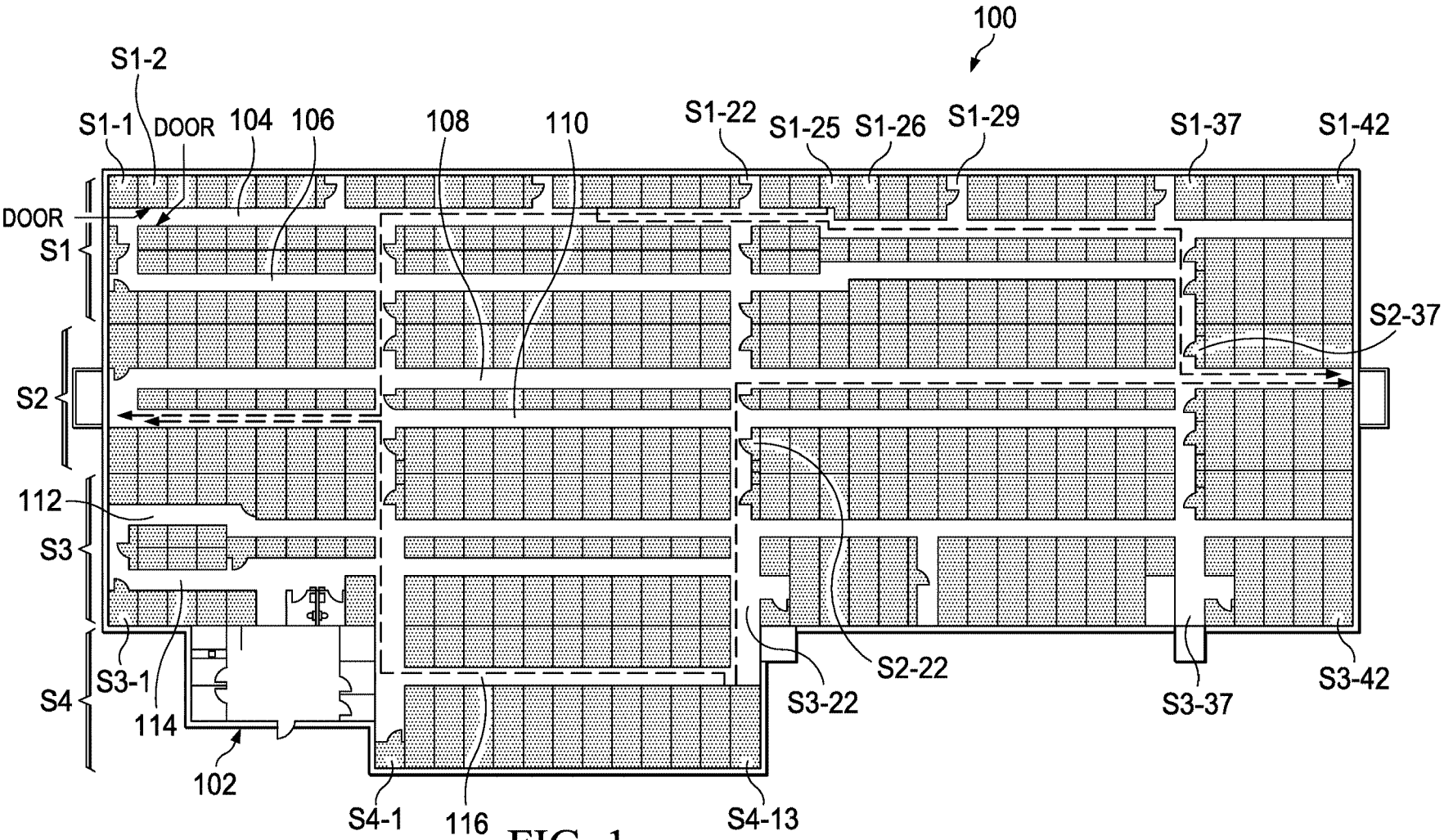
FIGS. 1 through 3 illustrate plan views of respective sets of LBMUs from a self-storage facility, with each LBMU set corresponding to a respective level 100, 200, 300 (or story) in a multi-level self-storage facility, so that FIG. 1 is the first floor.
Figure 2:
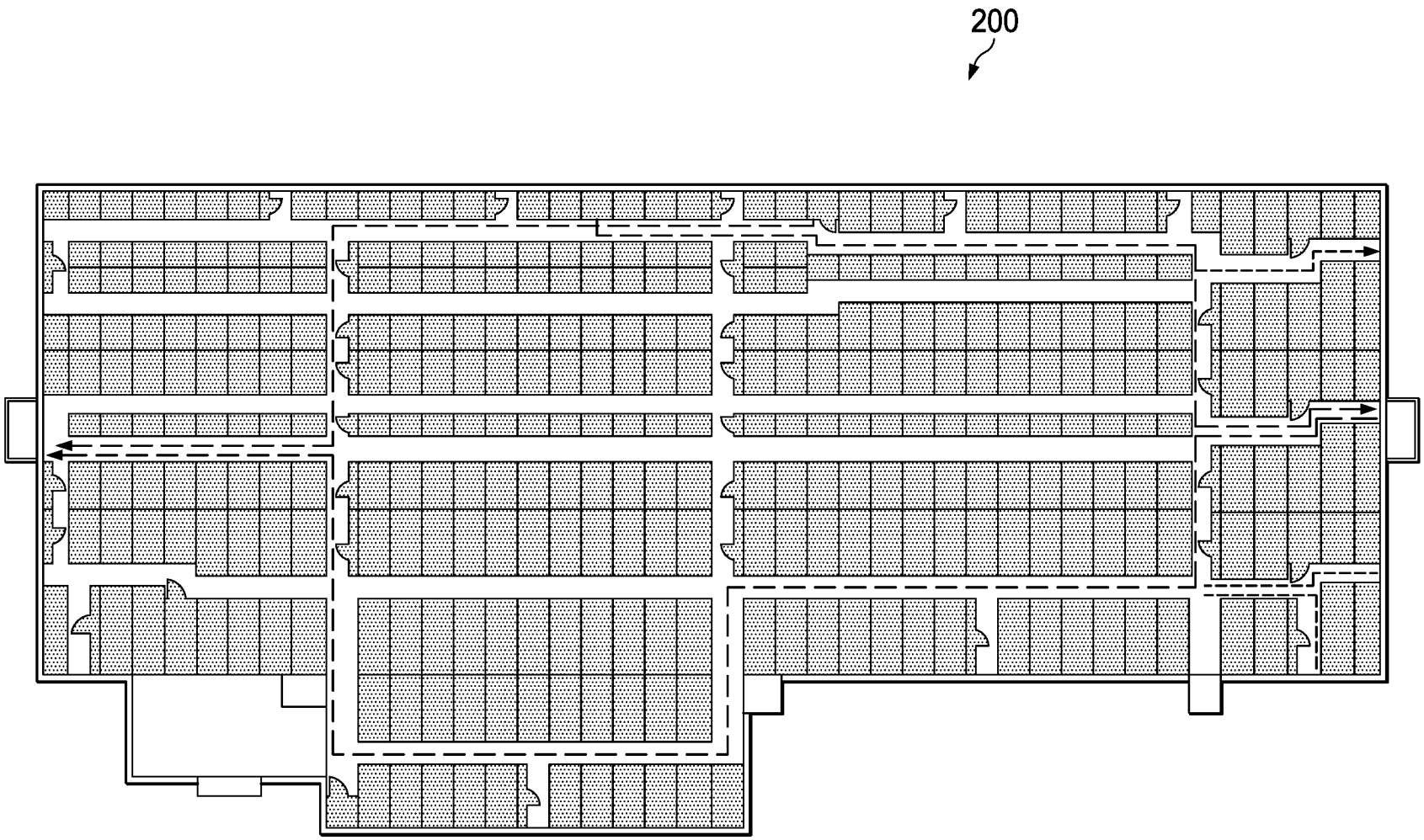
Figure 3:
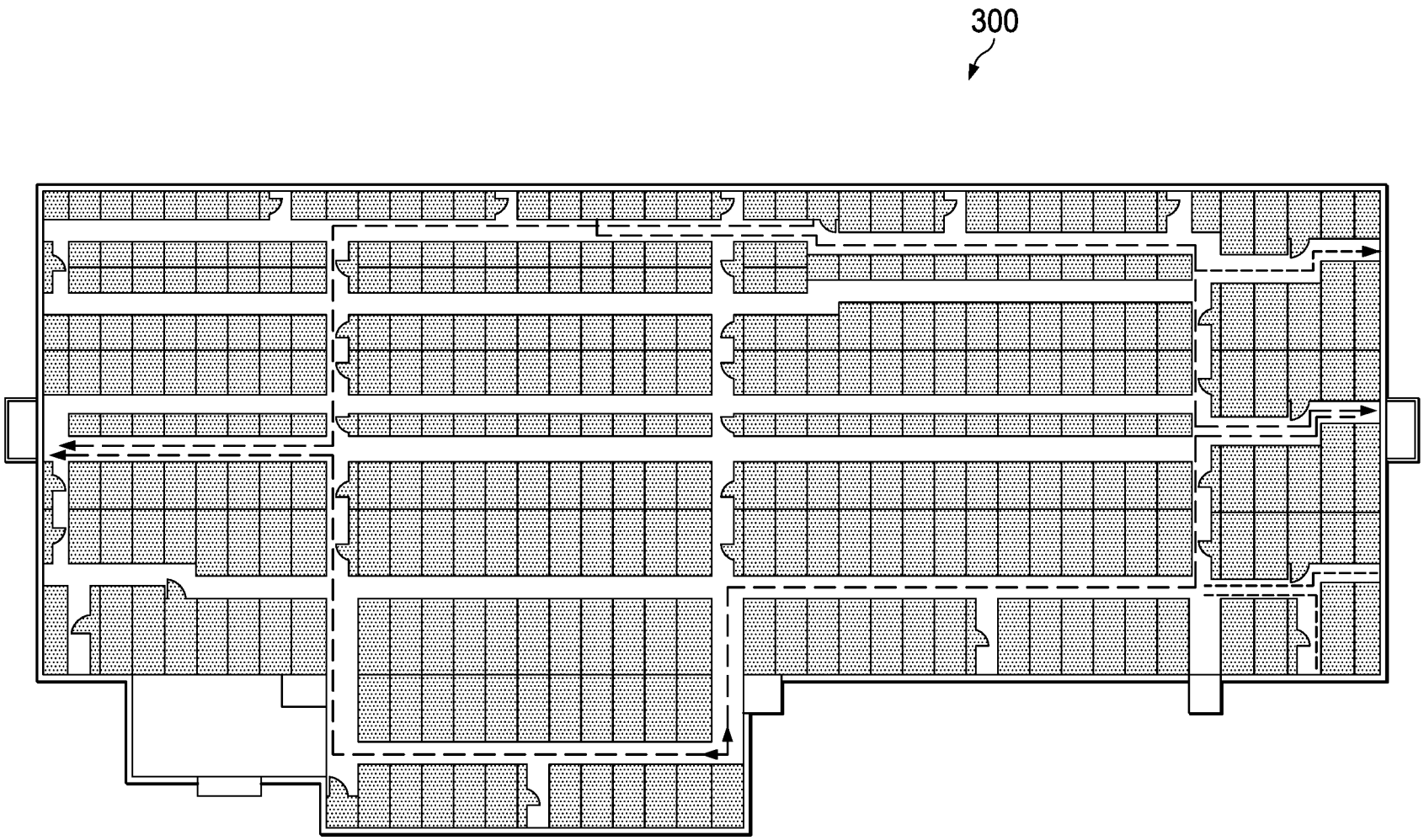

FIGS. 1 through 3 illustrate plan views of respective sets of LBMUs from a self-storage facility, with each LBMU set corresponding to a respective level 100, 200, 300 (or story) in a multi-level self-storage facility, so that FIG. 1 is the first floor, FIG. 2 is the second floor atop the first floor, and FIG. 3 is the third floor atop the second floor. Of course, the illustration of three levels is by way of example and indeed may be preferred in some instances (e.g., due to demand, demographic considerations, code restrictions, and so forth), and is not to be limiting to inventive scope. In each of FIGS. 1-3, each shown LBMU is outlined in a moderately darkened rectangle. Each LBMU may be implemented by an existing commodity, namely, by a standard commercial steel shipping or intermodal container or the like. Shipping containers are typically manufactured from metal and used to transport goods by truck, rail, and shipping vessel. In a preferred embodiment, however, the containers are stacked either on a substrate (e.g., ground or piles) or on top of and/or beside each other, as shown FIGS. 1-3. In more detail, the LBMUs are arranged side to side and end to end. For example, in FIG. 1, across the horizontal span of the page, there are shown three sets S1, S2, S3 of rectangles (i.e., LBMUs), with each set having a same number of LBMUs—in the example shown, each set has 42 such LBMUs. For convention, each LBMU may be referenced by it set number and left-to-right location in a FIG., so for example in set S1 it includes LBMUs starting to the left with S1-1 and ending to the right with S1-42. Each LBMU in a set (or at least a majority of the LBMUs in a set) has its major axis (i.e., axis running along its longest axial dimension) parallel to another LBMU in a set, so that the LBMUs are arranged in side-by-side fashion. Further, from one set to the next, the LBMUs are arranged in end-to-end fashion, for example, for an LBMU in set S1 having an end adjacent to an LBMU in set S2, such as between LBMU S1-1 and LBMU S2-1 (and similarly as between set S2 and set S3). Additional structure may be formed, either without LBMUs (e.g., at the bottom left corner of FIG. 1 shown an office area 102) or by additional LBMUs of a different number, for example as shown more centrally at the bottom of FIG. 1, in which there is a set S4 of side-by-side LBMUs, of a lesser number (e.g., 13) of LBMUs in the set as compared to other of the sets (e.g., S1, S2, S3) in floor 100.

Each of FIGS. 1, 2, and 3 also illustrates corridors generally as whitened paths, where the majority of linear feet of such corridors in the entire facility are transverse to the major axis of multiple parallel LBMUs, while a lesser amount of linear feet of such corridors are along the major axis of one or more LBMUs. For illustration in FIGS. 1, 2, and 3, generally the storage areas in sets S1 through S4 are shown shaded, while corridors are whitened. For example, in set S1, two corridors 104 and 106 are shown along the left/right direction, traversing through both sidewalls of most of the LBMUs in set S1. For these LBMUs, therefore, a same width and height aperture (e.g., in the area of 70 inches wide; approximately 105 inches tall (entire height from LBMU lower rail to upper rail)) is cut in each of the LBMU sidewalls at a same distance from a respective LBMU end, along opposite sidewalls of the LBMU, thereby providing a corridor through each LBMU. Further, given the side-to-side alignment of the LBMUs in a set, with the corridor cut at a same-from-end position for a next adjacent LBMU, the corridor continues similarly through the next adjacent (in a side-to-side sense) LBMU. For example, looking across the top set of 42 LBMUs of FIG. 1, the two corridors 104 and 106 start at the left of set S1 and cut through a total of 24 of the LBMUs. In the $25^{th}$ LBMU indicated as S1-25, an offset in the continuity of each corridor 104 and 106 may be created by cutting one side (e.g., left side) of that LBMU slightly wider, and then cutting the opposite side (e.g., right side) of the LBMU S1-25 back to the same width as the width of all other to-the-right LBMUS such that the cuts again are aligned for some or all of the remaining LBMUs, or there may simply be a shift in alignment as between the cuts on the opposing sidewalls of an LBMU, whereby one sidewall set of cuts are a different distance from the LBMU end than the other sidewall set of cuts. So, for instance corridor 104 continues through the entire set, with the portion of the corridor between LBMUs S1-26 to S1-42 being slightly offset relative to the same corridor between LBMUs S1-1 and S1-25.

Positioning of corridors according to preferred embodiments may influence various factors. For example, nominally each LBMU has a floor dimension of 8' by 40', or a total of 320 square feet of internal space. Looking then at corridor 104, consider a person walking from left to right of FIG. 1, along corridor 104. In this example, as the person traverses from LBMU S1-1 to the right, for each LBMU through which they walk, to their left (direction north in FIG. 1) is a same sized storage space, with the dimension of that space determined by the width of the LBMU (i.e., 8'), and the distance from the end of the LBMU that corridor 104 is located; so, for example, assume that to the left of corridor 104 is 9' depth of each storage space, then the storage space in LBMU S1-1, S1-2, etc. is approximately 8'×9'=72 square feet (other than a few spaces shown as having additional configurations). In a preferred embodiment, a door (e.g., a standard roll-up door, such as in the above-incorporated U.S. Pat. No. 10,280,608) is located at the front of that storage space, where the door may be 5' to 6' in width. Thus, in contrast to the U.S. Pat. No. 10,280,608 wherein the roll-up door is shown in a shipping container sidewall aperture, in the present teachings the sidewall aperture provides a pathway through the container, and to each side of that pathway is located a non-load bearing wall in which a door (again, such as roll-up) is affixed. Accordingly, as a person walks along the corridor of the present facility, they are most often passing transverse to the axis of each LBMU through which they pass, and each door access to each storage volume in an LBMU, to either the left or right of the walking direction, is also along an added wall (not originally part of the standard LBMU) in that same transverse-to-the-LBMU major axis path, rather than locating the door in the LBMU sidewall. Further, the remainder of the 8' width can be on the added wall on which the door is located, or the space may be further divided with internal, non-load bearing walls to apportion either space inside the 72 square feet or outward or to the side of the door (e.g., to provide lockers or other storage in the vicinity). This same use of doors is included throughout most if not the entirety of the facility, so at most if not all instances to the left and right of a corridor (e.g., corridor 104 or 106) as it traverses each LBMU. For sake of simplifying the Figures, only two such doors are indicated in FIG. 1 (for LBMU S1-2), but others should be understood along each corridor as it traverses the major axis of an LBMU.

In another corridor aspect, for example when corridor 104 reaches LBMU S1-25, there is a slight jog of offset, so that corridor 104 is transitioned to a second distance that is farther from the same end of each of the remaining LBMUs in set S1, for example, if the second distance is 12', then to the left of corridor 104 in LBMU S1-25, and farther to the right in FIG. 1, is 12' depth of each storage space, then the storage space in LBMU S1-26, S1-27, etc. is approximately 8'×12'=96 square feet. Accordingly, while a corridor in the illustrated embodiments traverses the major axis of plural respective side-by-side LBMUs, it may be selectively offset to change the available storage sizes on each side of the corridor. One skilled in the art will appreciate that the same applies to the other corridors shown, and to both sides of each corridor.

Corridor 106 (and others) illustrates how a corridor that is transverse to major axes of side-by-side LBMUs also may transition to, or be intersected by, a corridor that is aligned along the major axis of an LBMU or to multiple end-to-end LBMUs. For example, looking to corridor 106 as it generally spans from left to right in FIG. 1, it continues to the right of LBMU S1-25 only to and through one sidewall passageway of LBMU S1-37, but there is no corresponding second sidewall passageway in LBMU S1-37. Accordingly, the passageway provided by corridor 106, once in LBMU S1-37, is extended along, rather than transverse to, the major axis of LBMU S1-37, whereby it may continue through LBMU S1-37 to corridor 104, or also through an open end (made either by cutting an end or removing the original equipment door(s)) of LBMU S1-37 and into a corresponding second set S2 LBMU, namely, LBMU S2-37, as the end of LBMU S2-37 is also open. Indeed, continuing along this path, note that both ends of LBMU S2-37 are open, whereby this same path likewise continues into the third set S3 corresponding end-to-end LBMU S3-37.

Having described corridors 104 and 106 in set S1 and with corridor 106 also allowing passage along a major axis of two (or more) LBMUs, one skilled in the art may identify other related corridors are attributes. Thus, set S2 also includes two corridors 108 and 110, each representing paired vertical cuts and the resultant passageway in opposing sidewalls of side-to-side LBMUs (e.g., containers) in a set, and with both corridors 108 and 110 passing through an LBMU S2-22 through which a path is oriented along its major axis, thereby permitting passage to either of its end-oriented adjacent LBMUs S1-22 or S3-22 (and the passage through LBMU S3-22 continues into LBMU S4-13).

The preceding has described paired corridors passing transverse to the major axis of a same LBMU, and corresponding therefore to two sidewall cuts on both sides of each LBMU; however, also shown in FIGS. 1-3 are instances where only a single corridor traverses through opposite-side aligned sidewall apertures (cuts) in an LBMU. For example in FIG. 1, corridor 112 is paired with corridor 114 in LBMUs S3-1 to S3-22. However, corridor 112 continues through both sides of LBMU S3-22, while generally corridor 114 does not (although, as shown, corridor 114 may extend into S3-23 to form an accessible area in S3-23 but not further extending to the next side-to-side LBMU S3-24); hence, to the bottom right of FIG. 1, corridor 112 continues from LBMU S3-23 as a single corridor to, and through, LBMU S3-37, and terminates at LBMU S3-42.

FIGS. 1-3 also illustrate that in some instances, smaller (e.g., 3 feet deep) storage spaces may be constructed in LBMUs (e.g., S1-29) or in certain (e.g., 8 feet wide) longitudinal corridors, resulting in a 5 feet wide hall As needed, the 3 feet deep units can be used as closets to hide vertical HVAC ducts. In this regard, in a preferred embodiment, vertical ducts are formed from the top of the uppermost level (e.g., three levels) down to the lowest level, and roof-located air handlers/HVAC units are atop the facility. For example, air may flow downward through such ducts at or near the ends of the facility, with air returned toward its middle and then back upward to the roof-located air handlers/HVAC units. Such delivery and return ducts are preferably aligned vertically through all levels (and hence through LBMU's on each level). Smaller spaces (e.g., in corridors) also may serve as mop rooms, mechanical rooms, or to house other utilities.

The plan views of FIGS. 1-3 also demonstrate that positioning in one level, and stacking among vertical levels, of LBMUs also may be methodically selected according to preferred embodiments. For example, by starting at one end or border of the plan view perimeter, LBMUs may be stacked one level LBMU atop another in a vertical plane, so as to build away from the perimeter area where construction commences. In this way, as LBMUs are so stacked, additional work with respect to already-stacked LBMUs may commence, while others are still being stacked. Further, equipment used for positioning and stacking also may be more readily accommodated within or near the overall outer perimeter of the entire facility.

Figure 4:
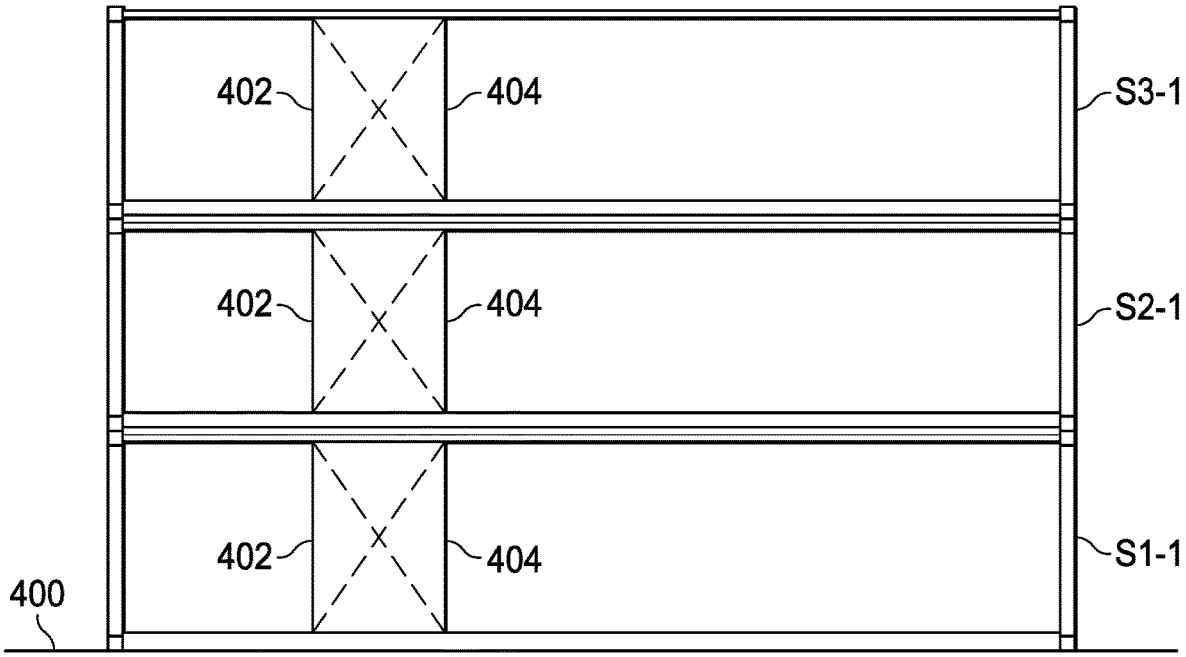
FIG. 4 illustrates a side view of three levels of stacked LBMUs, by way of an example of how corridors may be formed and aligned vertically.
Figure 5:
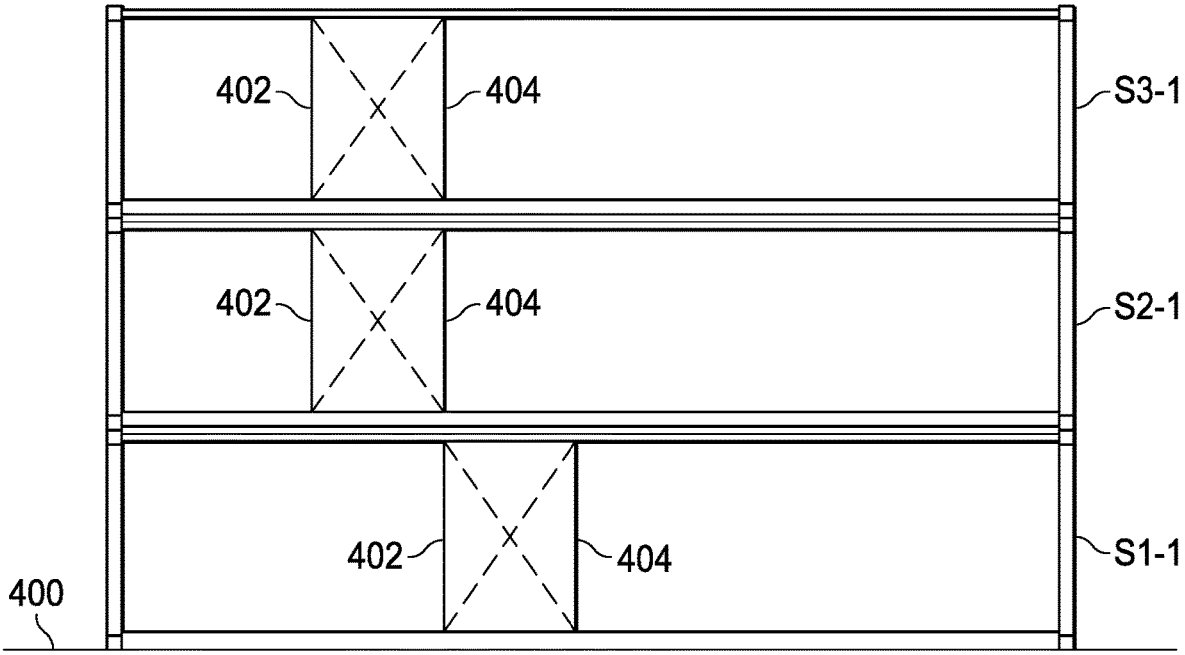
FIGS. 5-10 illustrate alternative approaches to FIG. 4, where there still is vertical alignment with at least one vertical sidewall cut and another in a level above or below it.
Figure 6:
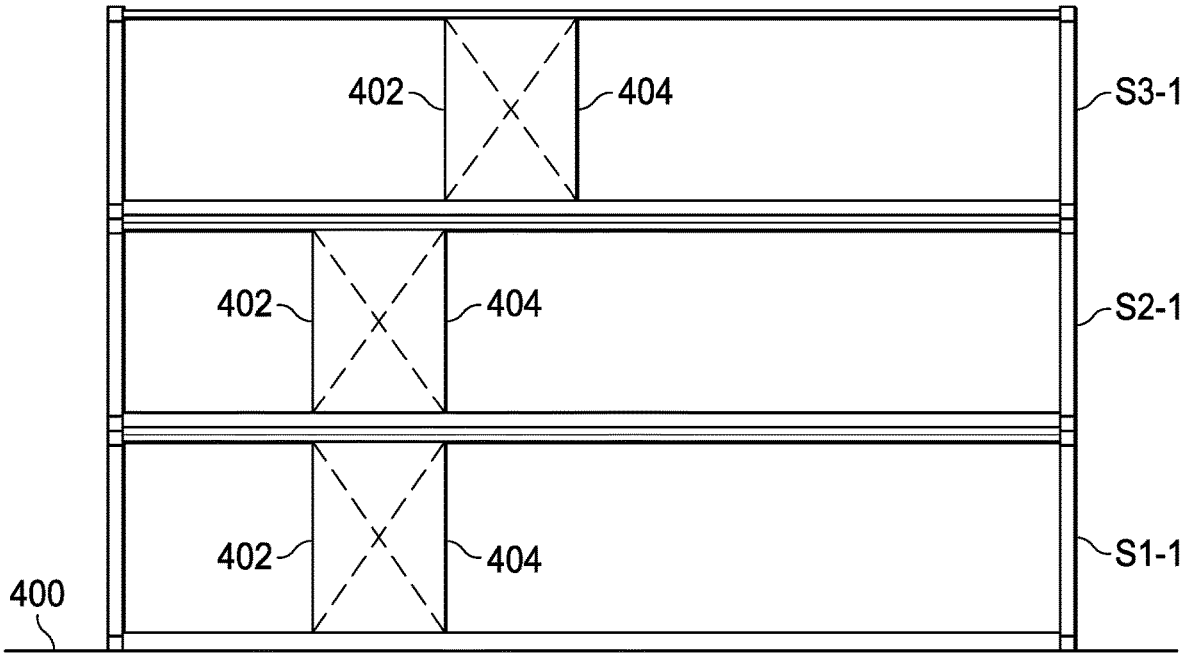
Figure 7:
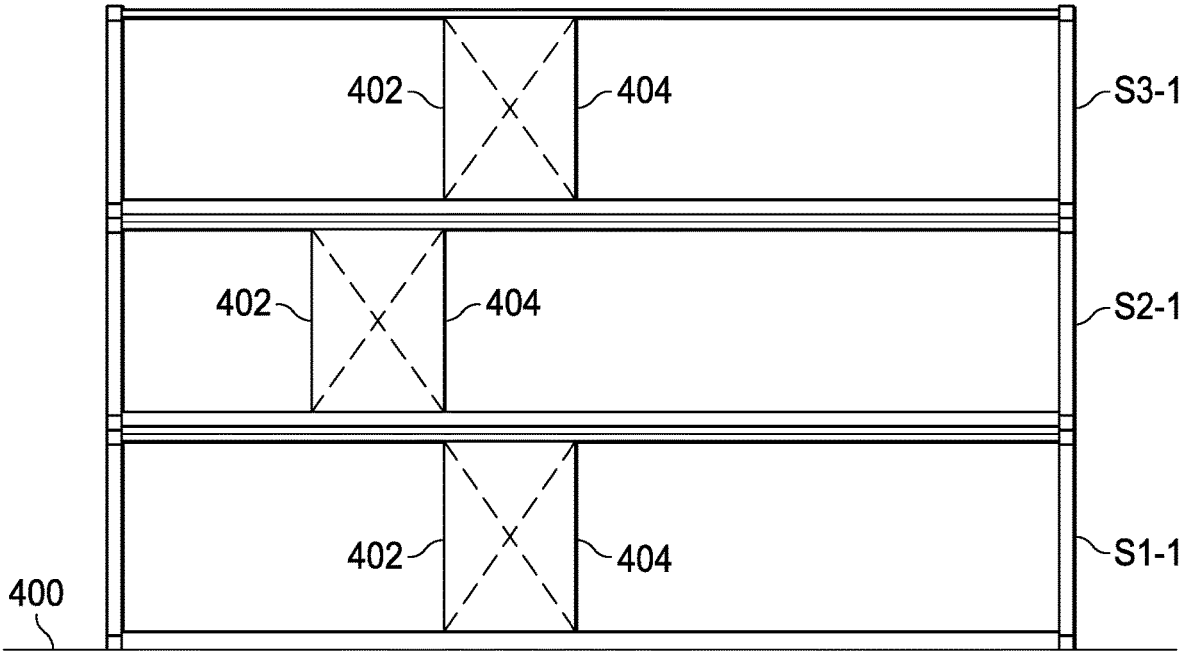

FIG. 4 illustrates a side view of three levels of stacked LBMUs, by way of an example of how corridors may be formed and aligned vertically. Using the same convention of earlier FIGs., but here applying the convention of a set per level (or floor), there is shown a first LBMU S1-1 atop a substrate 400, such as a foundation (e.g., concrete or other) formed on the ground, thereby serving as part of the first floor or level of a facility. Atop LBMU S1-1 is an LBMU S2-1, thereby serving as part of the second floor or level of the same facility. And, atop LBMU S2-1 is an LBMU S3-1, thereby serving as part of the third floor or level of the facility. All three LBMUs in FIG. 4 are vertically by their respective corner blocks (also referred to as corner castings), which also can be welded to a nearby or touching corner block, either horizontally or vertically or in both planes. Each of the three LBMUs is shown to have two vertical cuts 402, 404 in its respective sidewall, thereby forming a passageway into the LBMU (the opening shown by a dashed X), that is, an opening of sufficient width, for example through which a human can pass (e.g., 2' to 8'). Consistent with FIGS. 1-3, like-positioned cuts may be made at the same locations on opposing sidewalls, thereby forming a corridor through and transverse to the major axis of each LBMU. Also, while FIG. 4 illustrates only three LBMUs, one skilled in the art should appreciate that the descriptions herein apply to the various of the many like positioned LBMUs in each level and in both the horizontal plane along that level and in the vertical plane to a level, if any, above or below it.

Figure 8:
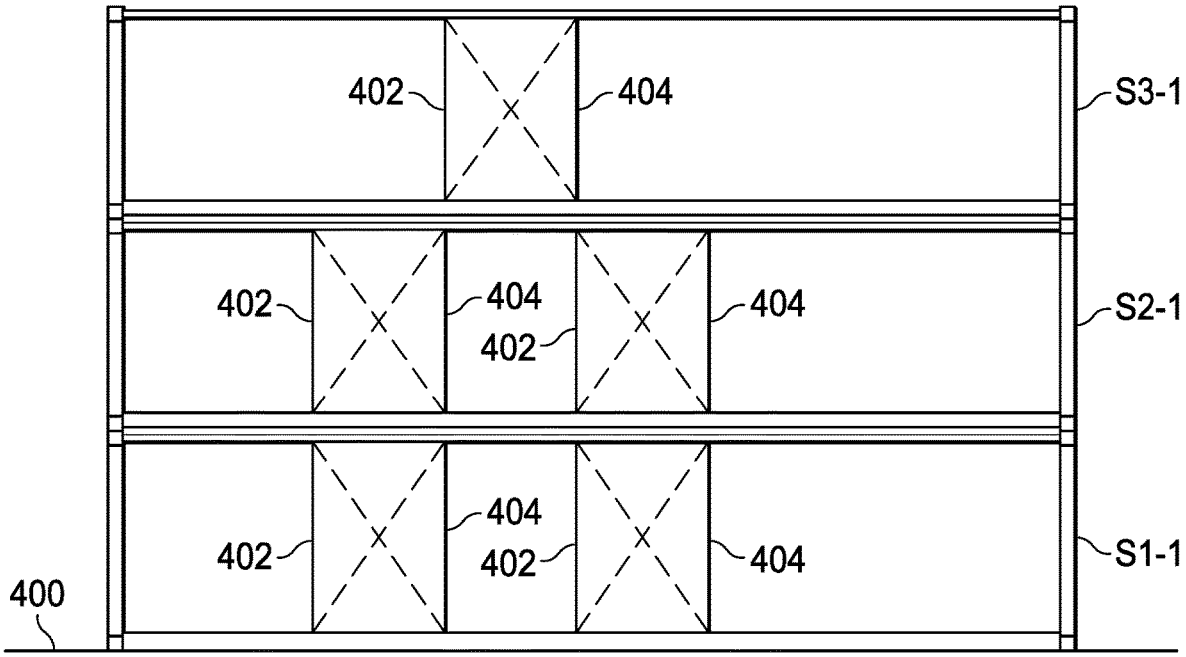
Figure 9:
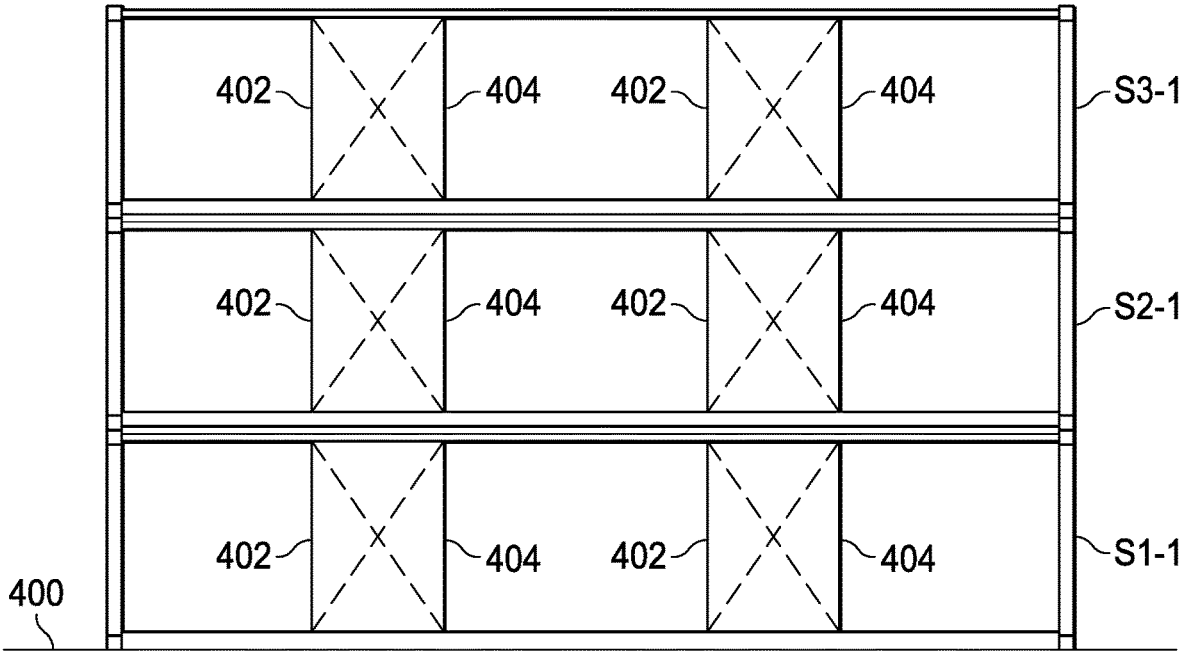
Figure 10:
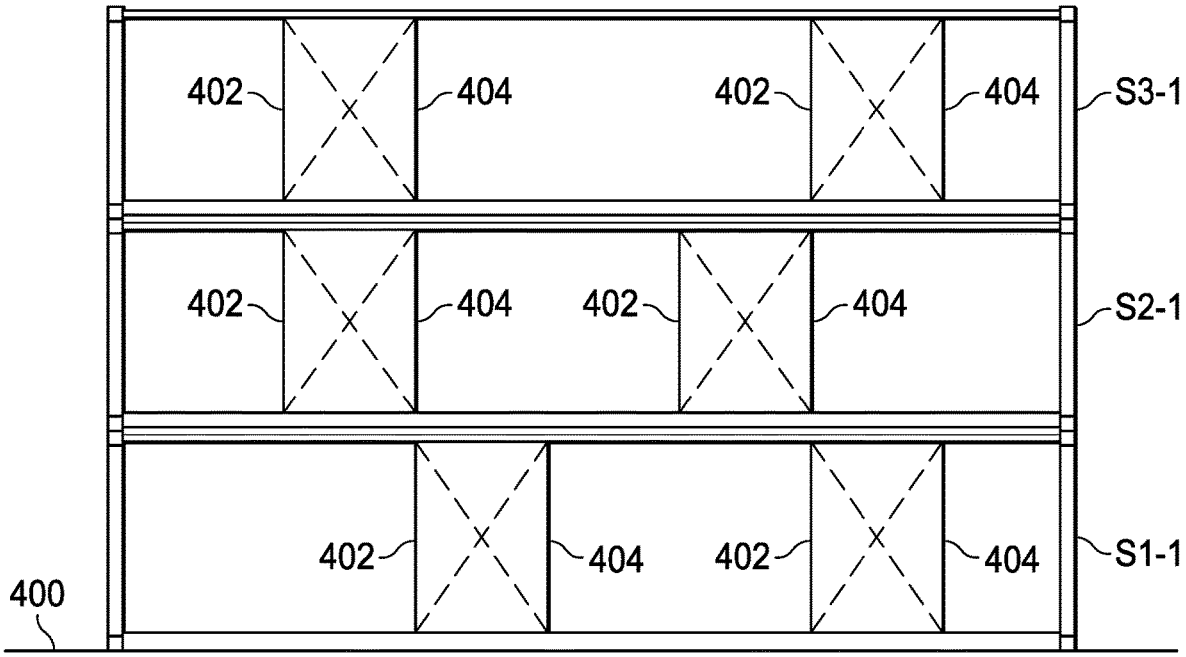
Figure 11:
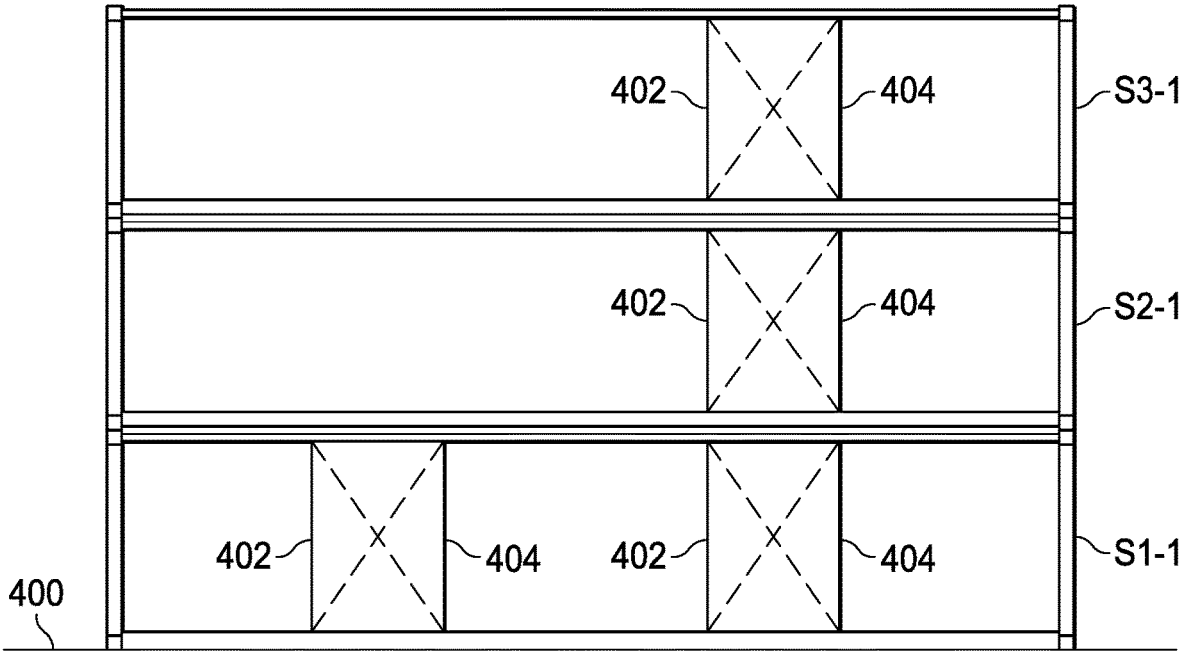
FIG. 11 illustrates an alternative approach to FIGS. 4-10, where one first level aperture is formed by cuts above which there is no vertical alignment to a second or third level sidewall cut.

In a preferred embodiment, between at least two successive vertical levels (e.g., S1 to S2, or S2 to S3), at least one vertical sidewall cut in one LBMU sidewall vertically aligns, or is at least within 12" or less (preferably 6" or less), with a vertical sidewall cut in the LBMU either above it or below it. In the example of FIG. 3, all such vertical cuts are so aligned, so that cuts 402 in each of LBMUs S1-1, S2-1, and S3-1 are vertically aligned, and similarly cuts 404 in each of LBMUs S1-1, S2-1, and S3-1 are vertically aligned. FIGS. 5-9 however, illustrate alternative approaches, where note, therefore, that there is vertical alignment with at least one vertical sidewall cut and another in a level above or below it. Such alignment provides for sufficient load bearing and load transfer, potentially in combination with additional reinforcement described below, while still permitting sidewalls to be opened in one or both sidewalls of the LBMUs and providing adequate load bearing and strength, as borne by aligning the LBMU corner blocks and further in view of the vertical cut alignment and reinforcement. Additionally, in some embodiments up to two corridors may be formed through an LBMU, provided therefore by four vertical cuts in an LBMU sidewall (and in the opposing sidewall, not shown in the perspective of those FIGs.), as shown in the examples of FIGS. 8 through 10. Four cuts (or two corridor apertures) or fewer are preferred, however, as an increased number of cuts (e.g., three sidewall openings/six vertical cuts) may lead to reduced sidewall load bearing, thereby requiring additional complexity, time, and cost in further reinforcing the LBMUs. Lastly, note that for a first level pair of vertical cuts (i.e., forming an LBMU sidewall opening), there may be no aligned cuts in the LBMU in the second level, such that the second level LBMU provides a sidewall vertically aligned above the vertical cuts in the lower first level LBMU, thereby providing overall strength in the vertical direction due to the lack of additional sidewall cuts vertically above the first level—an example of this is shown in FIG. 11.

Figure 12:
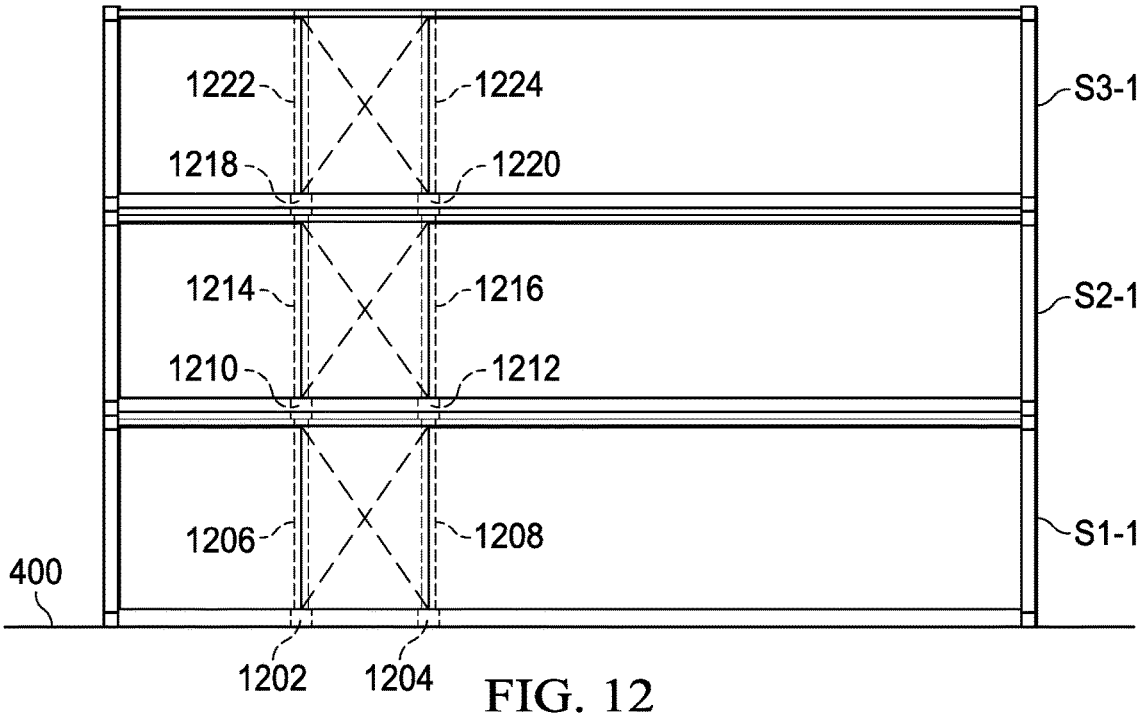
FIG. 12 illustrates the structure of FIG. 4 with vertical dashed indications of vertical reinforcement apparatus.

FIG. 12 again illustrates the structure of FIG. 4, and added in FIG. 12 are vertical dashed indications to introduce vertical reinforcement apparatus according to a preferred embodiment. Particularly, for some or all vertical cuts, there is preferably additional structure aligned at or near the cut providing vertical support that aligns with the cut (either vertically or to the later side of the cut) and also provides support to structure beneath the cut; additionally, if there is an LBMU above the cut and that vertically upward LBMU also has a cut vertically aligned to a cut in the LBMU beneath it, then the vertical support below extends also to that upward LBMU. In FIG. 12 generally, therefore, there is shown:

(1) vertical support members 1202 and 1204 between substrate 400 and the upper portion of the LBMU S1-1 bottom rail;

(2) vertical support members 1206 and 1208, atop or supported by vertical support members 1202 and 1204, and parallel to the LBMU S1-1 sidewall and nearby each respective vertical cut in the LBMU S1-1 sidewall, with support members 1206 and 1208 either directly, or through an intermediate structure, extending just above the LBMU S1-1 top rail;

(3) vertical support members 1210 and 1212 between and supported by support members 1206 and 1208, respectively, and the upper portion of the LBMU S2-1 bottom rail;

(4) vertical support members 1214 and 1216, atop or supported by vertical support members 1210 and 1212, and parallel to the LBMU S2-1 sidewall and nearby each respective vertical cut in the LBMU S2-1 sidewall, with support members 1214 and 1216 either directly, or through an intermediate structure, extending just above the LBMU S2-1 top rail;

(5) vertical support members 1218 and 1220 between and supported by support members 1214 and 1216, respectively, and the upper portion of the LBMU S3-1 bottom rail; and (6) vertical support members 1222 and 1224, atop or supported by vertical support members 1218 and 1220, and parallel to the LBMU S3-1 sidewall and nearby each respective vertical cut in the LBMU S3-1 sidewall, with support members 1222 and 1224 either directly, or through an intermediate structure, extending just above the LBMU S3-1 top rail.

Figure 13:
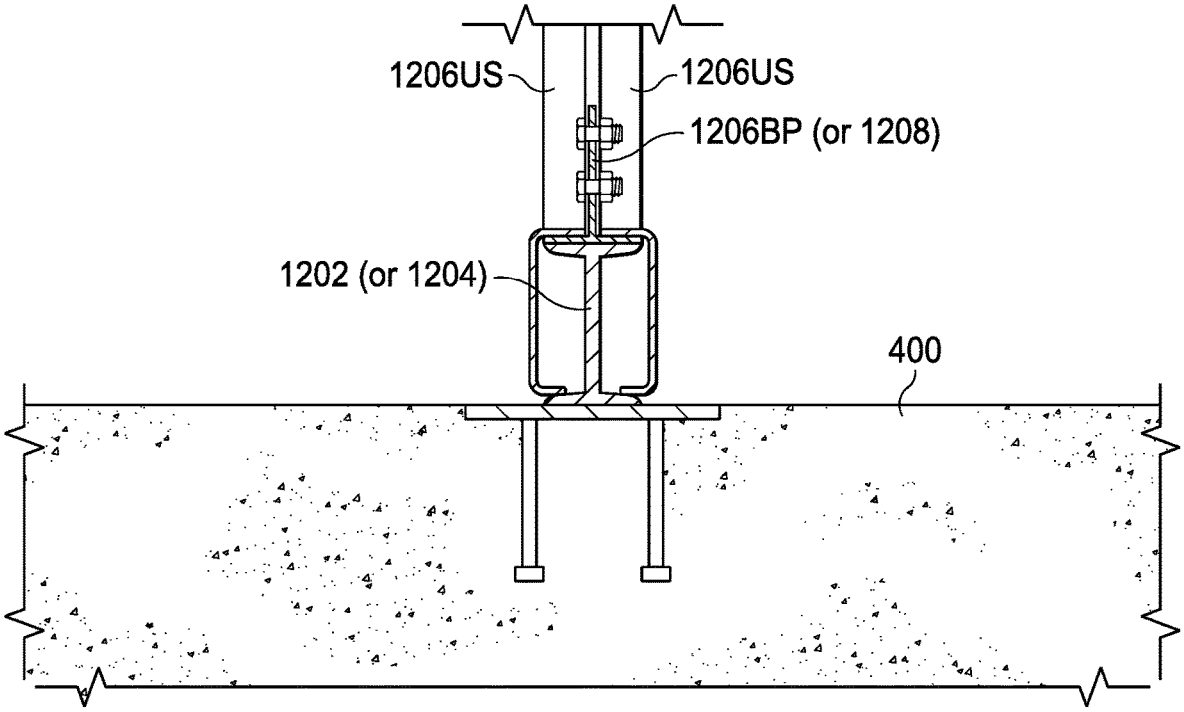
FIG. 13 illustrates a cross-sectional elevation view of substrate 400 and of two opposing-faced LBMU bottom rails, along with vertical support member 1202 (or 1204).

FIG. 13 illustrates a cross-sectional elevation view of substrate 400 and of two opposing-faced LBMU bottom rails, along with vertical support member 1202 (or 1204) shown in greater detail. From this view, the cross section of vertical support member 1202 illustrates an I-beam used for member 1202, whereby the bottom of the I-beam contacts either substrate 400 or, as shown, a plate embedded in substrate 400. The I-beam can have a lateral width, for example, between 3" and 6". Substrate 400, or that plate, thereby supports the bottom of the I-beam, and the top of the I-beam contacts, either directly or through shim(s), the underside of the upper portion of the LBMU bottom rail. For example, when stacking the LBMUs, the I-beam support member 1202 (or 1204) is positioned atop the plate (and can be welded thereto), and a first LBMU may be positioned in place, with a portion (approximately one half side) of the I-beam fitting within the bottom rail of that first LBMU, and with the upper "C-shaped" portion of that upper rail fitting atop the I-beam, or atop shimming placed between the top of the I-beam and the underside of the C-shaped portion. At that point, therefore, the I-beam support member 1202, and the vertical apparatus shown above it and described below, is thusly positioned before the second LBMU is similarly placed. Next, therefore, that second LBMU is brought to a side-by-side alignment with the first LBMU, with the I-beam then fitting within the bottom rail of that second LBMU, that is, with the upper surface of the I-beam contacting the underside of the upper "C-shaped" portion of that upper rail fitting of the second LBMU. Essentially, therefore, the underside of the upper portion of the C-shaped bottom rail for each of the side-by-side LBMUs is supported atop the I-beam (either directly or shimmed as needed).

Above the I-beam member 1202 is supported a portion of vertical support member 1206 (or 1208), which in the illustrated example is provided in part by a bent plate (e.g., ¼" thick 1½"×5" LLV) 1206BP. Bent plate 1206BP is connected by fasteners (e.g., bolts, with two shown) to a lower portion of a vertical support member, which can be a unistrut 1206US (e.g., 1⅝"), as further detailed later, where unistrut is a well-known brand name for an open channel generally square/rectangular cross-sectioned pipe, where the channel typically has the cross-section illustrated later in FIG. 16, whereby its open ends fold inward, used for example in other applications to receive cabling. Preferred embodiments, however, utilize unistruts for structural reinforcement, as detailed in various locations in this document. As the unistruct 1206US extends vertically upward, it also is affixed at spaced locations (e.g., 5 spaced apart locations for a length of unistrut of nominally 9') to a tie plate (not shown). Specifically, one side of the tie plate is attached to an LBMU sidewall, such as near a vertical cut. The tie plate other side extends away from the vertical cut into an open space (i.e., toward the corridor), leaving additional holes aligned vertically, and through which the bolts are passed to connect to the vertically extending unistrut.

Figure 14:
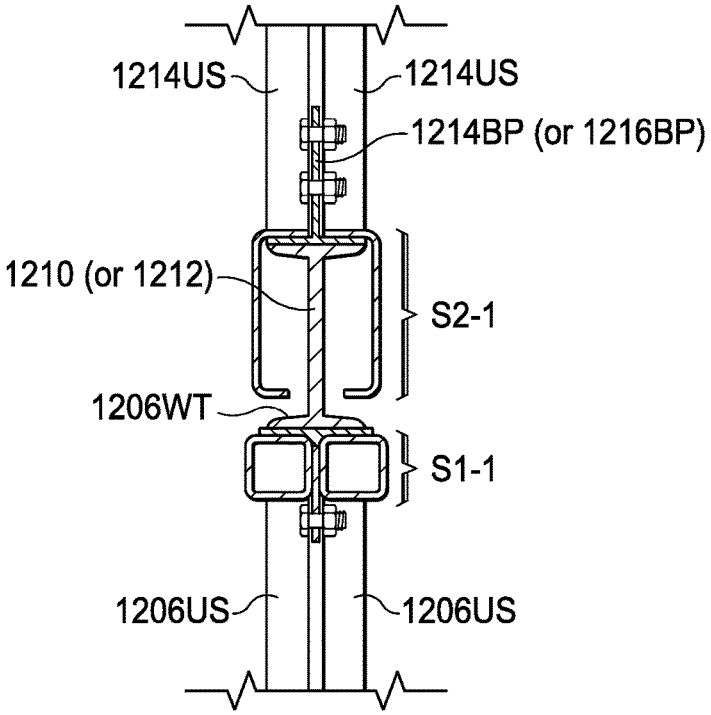
FIG. 14 illustrates a cross-sectional elevation view of the upper portion of vertical support member 1206 (or 1208, 1214, 1216, 1222, 1224) and above it 1210 (or 1212, 1218, 122).

FIG. 14 illustrates a cross-sectional elevation view of the upper portion of vertical support member 1206 (or 1208, 1214, 1216, 1222, 1224) and above it 1210 (or 1212, 1218, 122). In FIG. 14, shown along the bottom of the FIG. are two opposing-faced LBMU top rails corresponding to two LBMUs on the same level (e.g., first level). Also, recall from FIG. 13 that vertical support member 1206 includes unistruts 1206US, the top portion of which are shown in FIG. 14. At the top of those unistruts 1206US, they are connected (e.g., bolted) to an upper WT member 1206WT (e.g., WT4x5), which has a lower vertical portion between the upper rails to the two lower-level LBMUs, and an upper horizontal portion that is above those upper rails. Further, also shown is vertical support member 1210 (or 1212) in greater detail. From this view, the cross section of vertical support member 1210 also illustrates an I-beam member, whereby the bottom of the I-beam contacts the top of the LBMU top rail or the horizontal portion of WT member 1206WT. Hence, the top rail, or an adjacent WT member, of a lower level (e.g., S1-1) LBMU supports vertical support member 1210, and then the I-beam of member 1210 extends vertically upward, to support additional structure similar to that in FIG. 13, namely, a bent plate (e.g., ¼" thick 1½"×5" LLV) 1214BP, which is connected by fasteners (e.g., bolts, with two shown) to a lower portion of a vertical support member, which can be a unistrut 1214US (e.g., 1⅝"), as further detailed later. As the unistrut 1214US extends vertically upward, it also is affixed at spaced locations (e.g., 5 spaced apart locations for a length of unistrut of approximately 8') to a same type of tie plate 1220 described above in connection with FIG. 13.

Figure 15A:
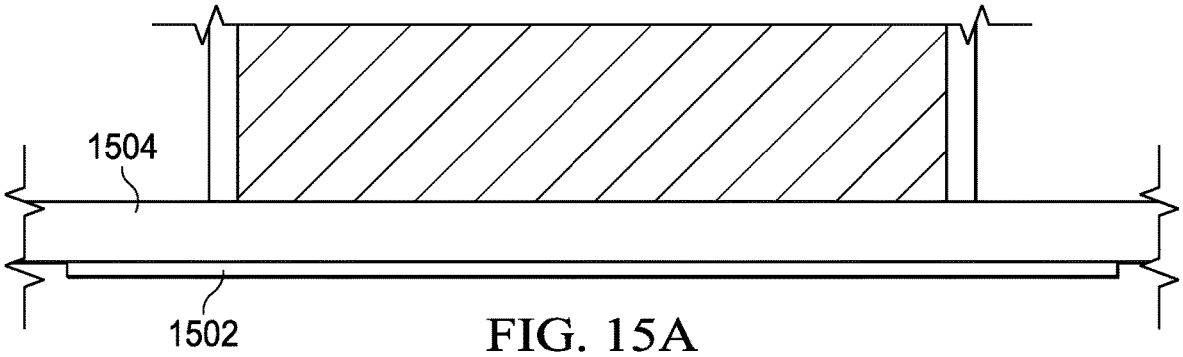
FIG. 15A illustrates an LBMU sidewall with an opening from vertical cuts.
Figure 15B:
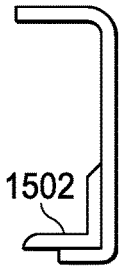
FIGS. 15B and 15C illustrates alternative lateral reinforcement along the opening of FIG. 15A.
Figure 15C:
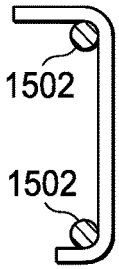

In addition to vertical support in connection with LBMU sidewall cuts and corridors, some preferred embodiments also include horizontal support in connection with sidewall corridor apertures, by applying a reinforcement member along the LBMU bottom rail, either nearby or under each vertical cut, or potentially extending under the entire width of the corridor and extending laterally slightly beyond that width. In this regard, FIG. 15A illustrates an LBMU sidewall with the "new opening" depicting a portion of the corridor passageway being 5' 10" wide, and then a lateral reinforcement 1502 extending along the LBMU bottom rail 1504. Cross sectional views across the LBMU bottom rail, and of alternative embodiment lateral reinforcement 1502, are shown in FIGS. 15B and 15C, in which FIG. 15B illustrates lateral reinforcement 1502 as a length of angle iron and FIG. 15C illustrates lateral reinforcement 1502 as a length of tubular bar (akin to rebar).

Figure 16:
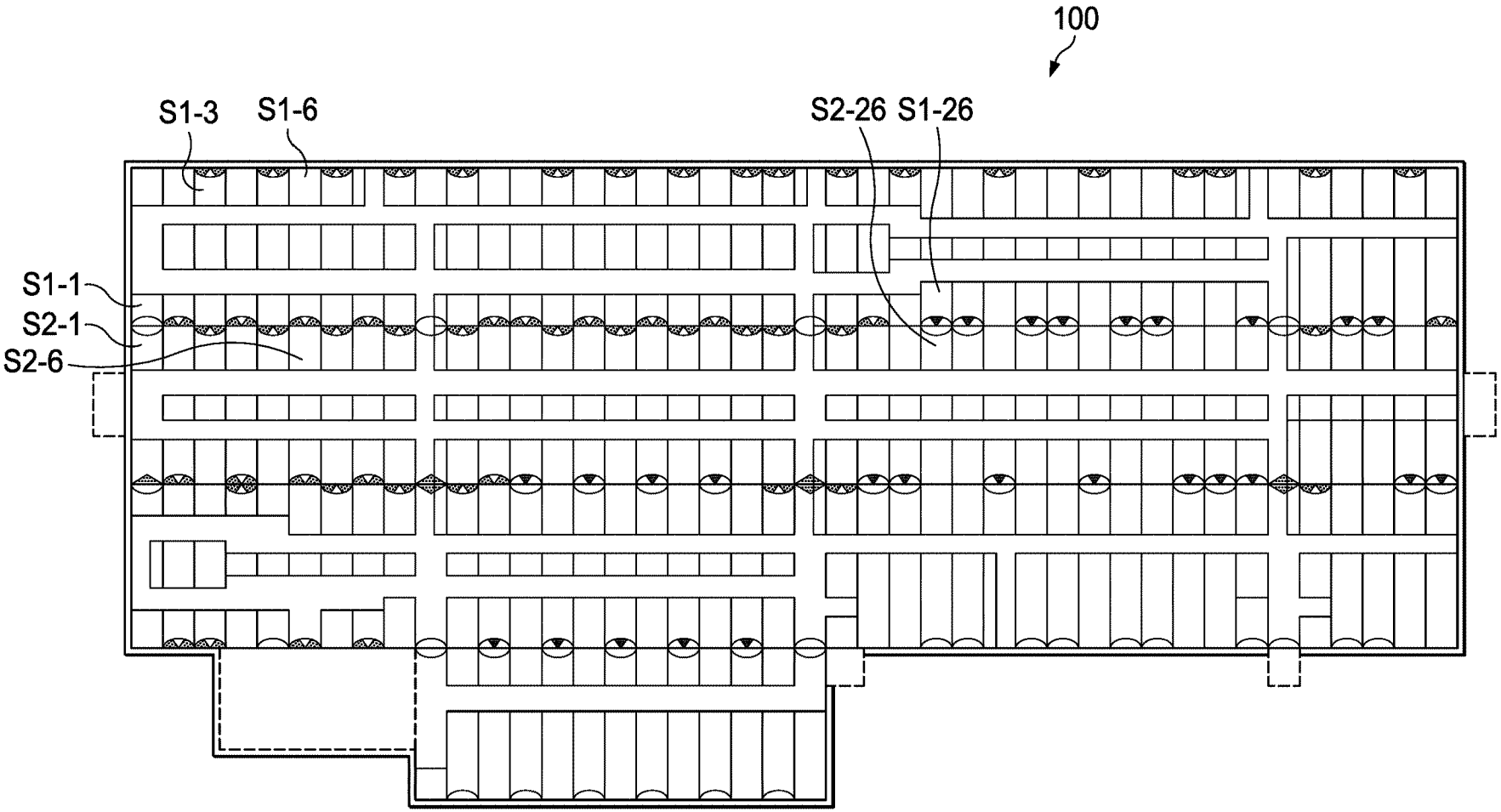
FIGS. 16-18 illustrate plan views again of the same three levels 100, 200, and 300, of LBMUs shown in FIGS. 1-3, respectively, with emphasis on a novel use of LBMU endwall doors.
Figure 17:
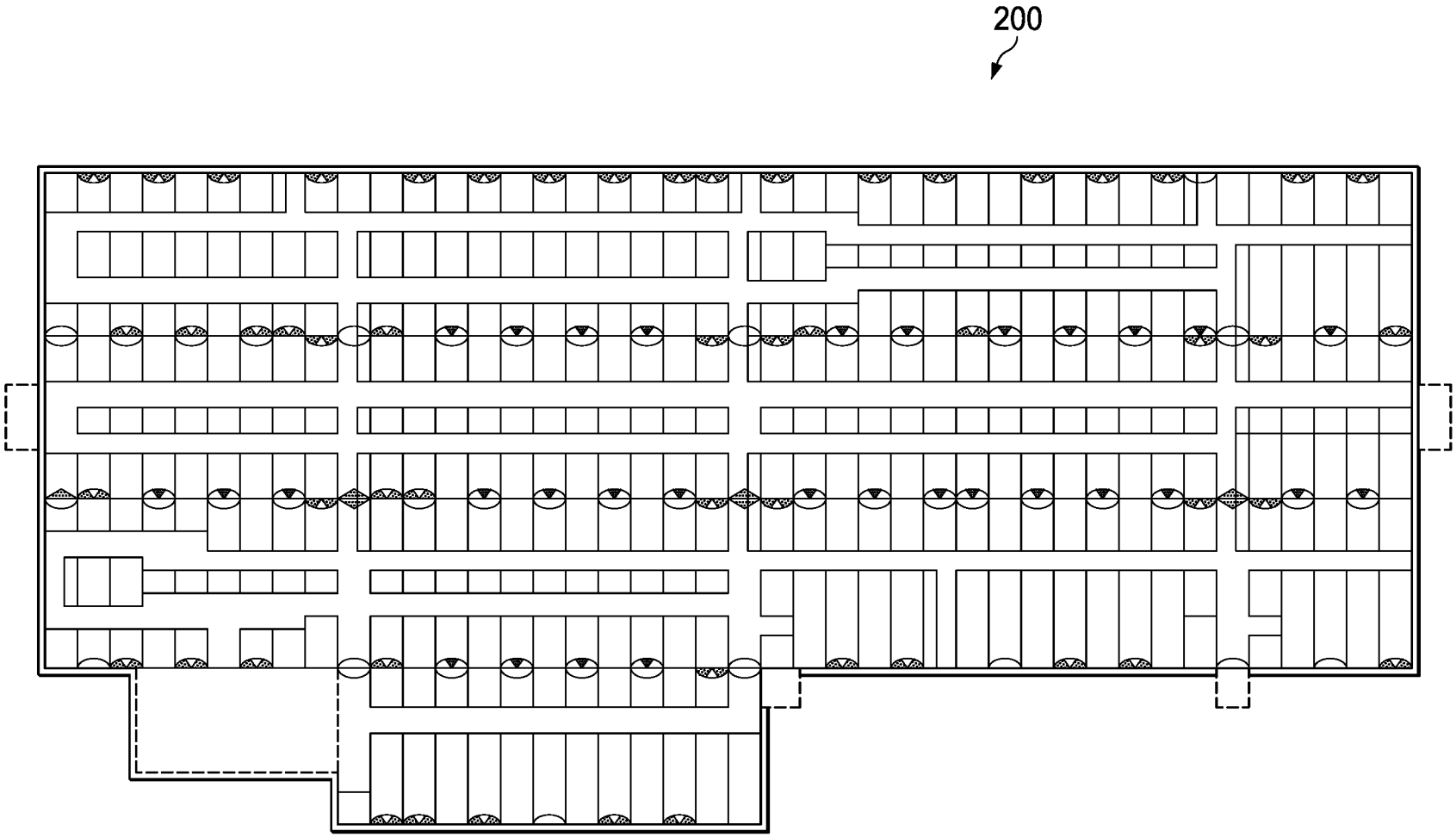
Figure 18:
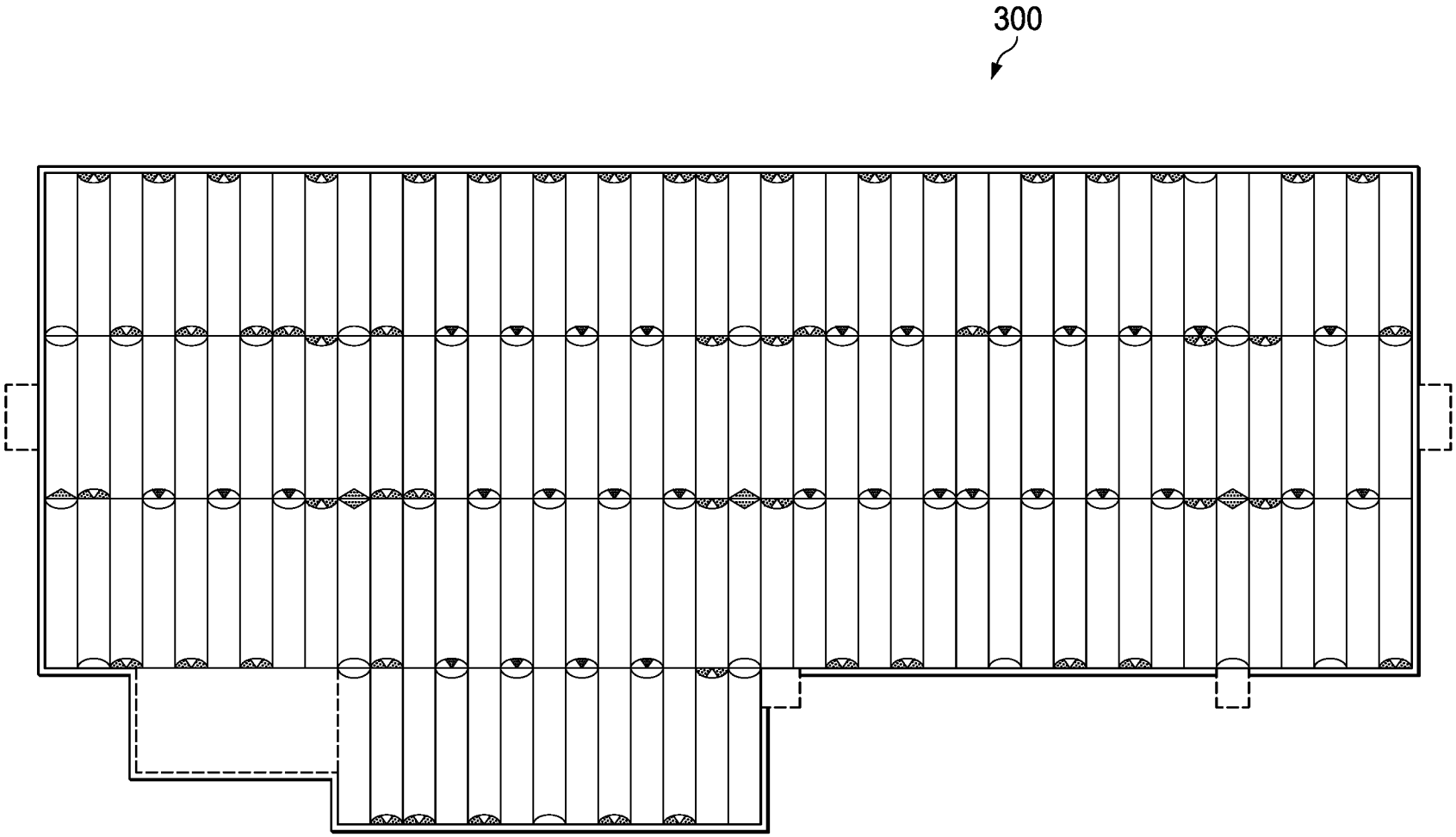

FIGS. 16-18 illustrate plan views again of the same three levels 100, 200, and 300, of LBMUs shown in FIGS. 1-3, respectively. However, in FIGS. 16-18, emphasis is on a novel use of LBMU endwall doors, so as to allow selective partitioning (or re-partitioning) of storage space within the facility formed by those levels (and possibly including other attributes, including exterior walls or facade, a ceiling, ingress and egress, and the like). Particularly, as known in the commercial shipping container art, a standard shipping container has at one of its ends (typically called the container rear end) a pair of doors, typically each a same dimension spanning approximately half the container width and, when opened, pivoting outward away from the container. In a preferred embodiment, and given the end-to-end alignment of LBMUs, then without any change in an original equipment manufacture (OEM) shipping container, these paired pivoting doors will exist at one of the two ends of each LBMU. However, given that the interior of LBMUs are used herein for storage space (or as corridors), then preferred embodiments selectively choose one of three options for the OEM paired pivoting doors, for some or all of the LBMUs (as shown by the legend in FIG. 19) and the corresponding use of the legend in the individual LBMUs): (1) removing the paired pivoting doors; (2) permanently affixing the paired pivoting doors to remain shut (e.g., by welding); or (3) leaving the pivoting doors operational, and facing them end-to-end to a second LBMU from which the paired pivoting doors have been removed.

The first option is shown for example in FIG. 16 LBMUs S1-1 and S2-1, where the removed paired pivoting doors are on ends of respective LBMUs that are facing. Notably, by having removed those doors, passage is permitted and thereby forms a coupling passageway between one end area of LBMU S1-1 and one end of LBMU S2-1, thereby combining those areas for walking from one LBMU to the other, and/or to combine the storage space from the ends of each of those LBMUs, or also permitting the combined space to be further divided by a partition wall, between the sidewalls of an LBMU, in which case a first portion of that space is accessible inside LBMU S1-1 and a second portion of that space is accessible inside LBMU S2-1. Accordingly, such combination permits selective creation of different storage space areas, by removing the end paired doors of two adjacent end-to-end LBMUs.

The second option is shown for example in FIG. 16 LBMU S1-3. By permanently affixing the paired pivoting doors of that LBMU to remain shut, a person inside its interior is prevented for opening those doors, which could give access to either an exterior wall attached thereto (if an exterior wall or façade is included) or to ambient.

The third option is shown, for example, in FIG. 16 as between the end-to-end oriented LBMU S1-26 and LBMU S2-26. In this third option, therefore, as the paired pivoting doors at one end of an LBMU remain operational (e.g., south end of S1-26), they may be opened essentially into the interior of the end-to-end oriented second LBMU (e.g., north end of S2-26), provided, for example, that the OEM gasket (and associated gasket keepers, locking rod pipes and appurtenances attached to the doors) from the door end of the second LBMU has been removed. Thus, where a single LBMU may provide a certain amount of accessible storage space from the corridor to its end that includes paired pivoting doors, by opening those doors into the interior of a second LBMU, then the interior of the second LBMU is accessible from the interior of the first LBMU, of which its paired pivoting doors are open. Such end-to-end and modification, therefore, permits a storage space to be enlarged from a portion (or all) of a first LBMU into a portion (or all) of second LBMU that is an end-to-end orientation with the first LBMU. Note that a perpendicular orientation also might permit such adjustment, assuming a sidewall cut were made in the second LBMU through which the paired pivoting doors of the first LBMU could be opened, but end-to-end orientation is likely preferred as more efficient. In all events, the ability to easily reparation storage space, particularly in large commercial self-storage facilities, has been generally unknown until addressed by the present inventors, either in earlier filings or as now described herein, and is believed to be of marked value to self-storage consumers, operators, owners, and investors. And, as now shown, preferred embodiments accomplish such results with remarkable efficiency.

Figure 20:
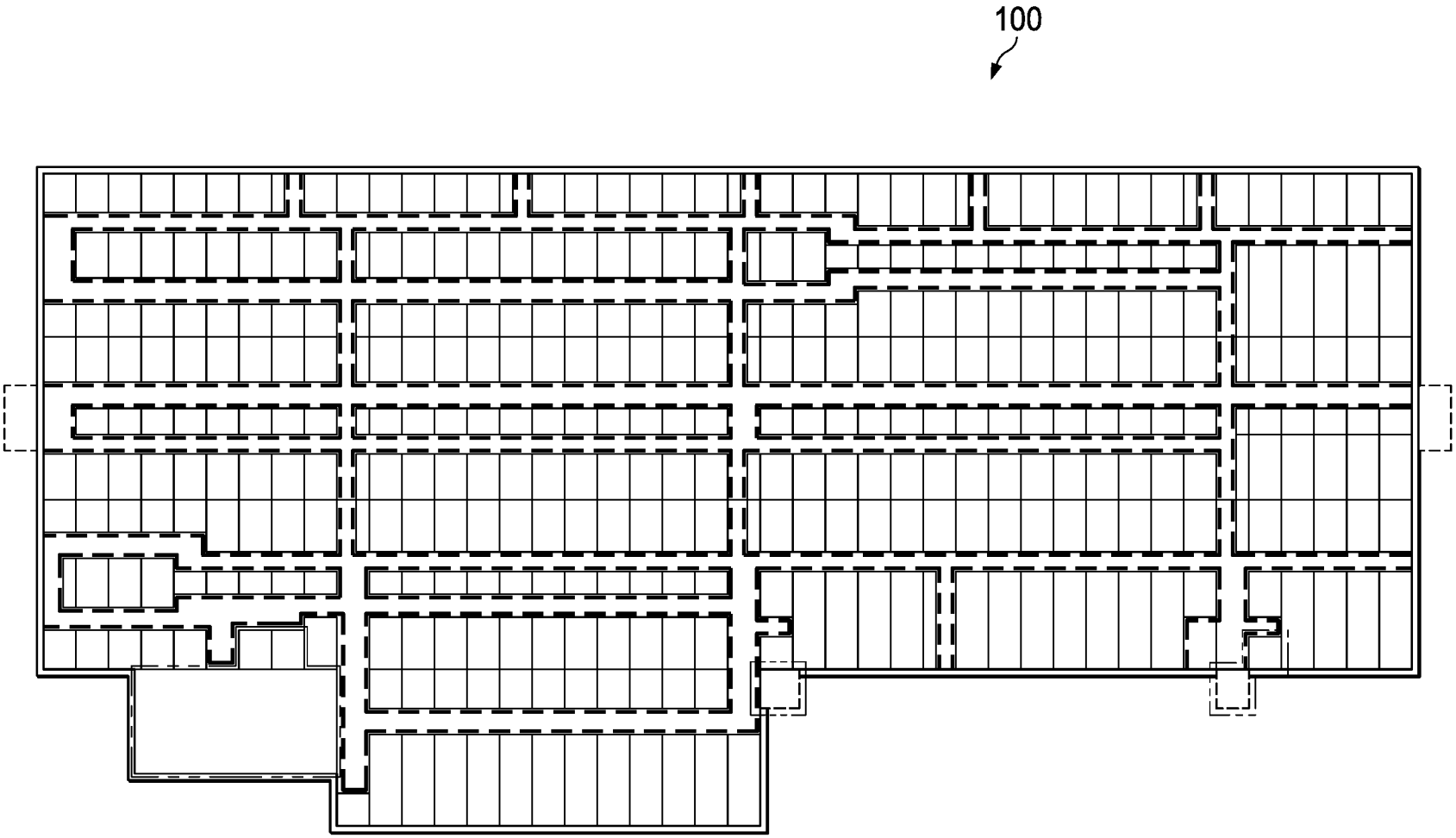
FIGS. 20-22 illustrate plan views again of the same three levels 100, 200, and 300, of LBMUs shown in FIGS. 1-3, respectively, but of the power and lighting features.
Figure 21:
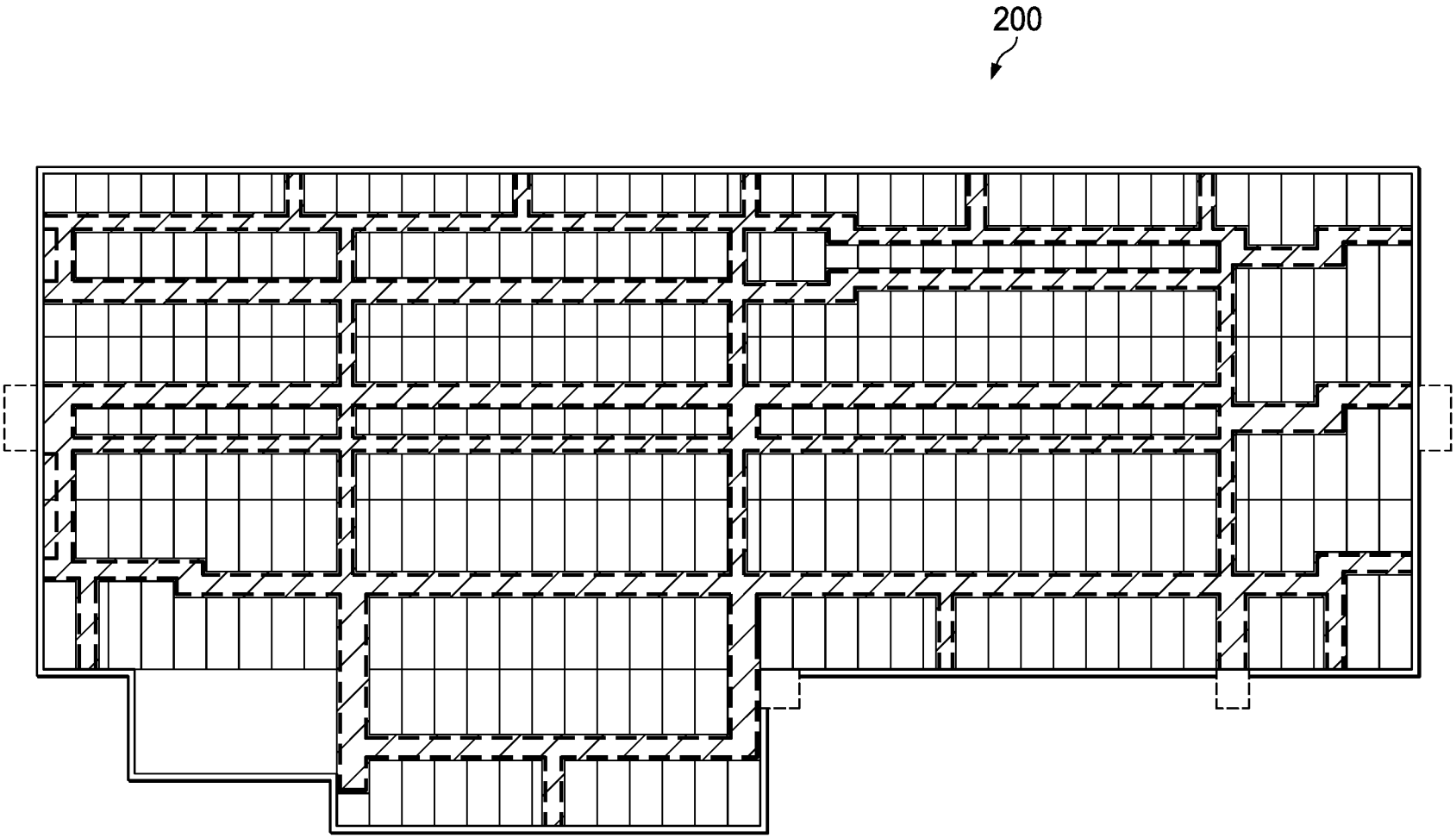
Figure 22:
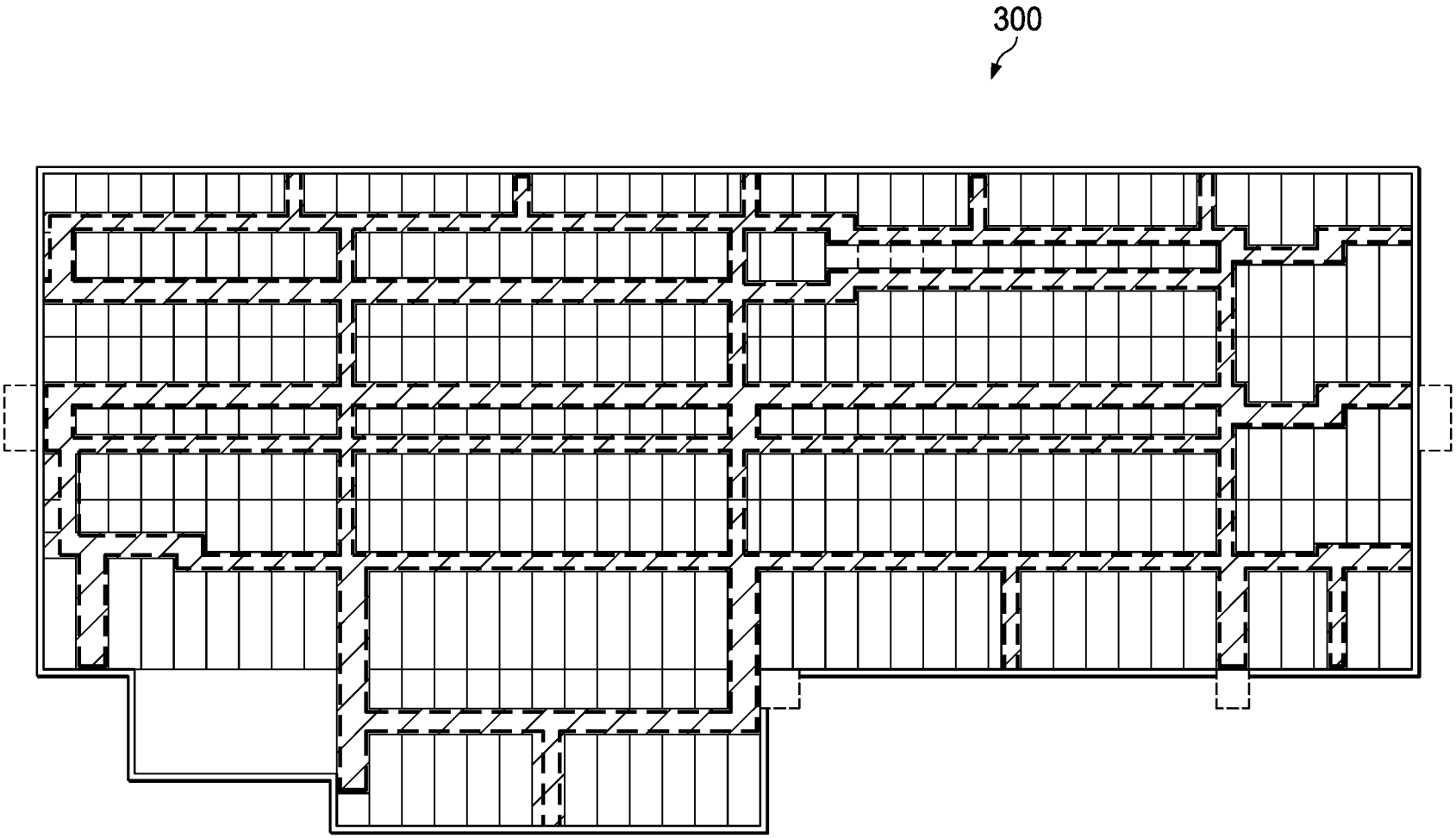

FIGS. 20-22 illustrate plan views again of the same three levels 100, 200, and 300, of LBMUs shown in FIGS. 1-3, respectively, but of the power and lighting features, with the legend shown in FIGS. 23A-23B. As shown, in a preferred embodiment, lighting along corridors is provided by strip lighting, preferably as a lengthy sequence of LED lights. Such lights can be easily installed, such as via adhesive along the overwhelming majority of the light strips. Further, such lighting can be attached along linear paths, such as along corridors, including those that traverse major axes of side-to-side LBMUs, and even along the upper door railing (e.g., unistruts) of such corridors.

Figure 24:
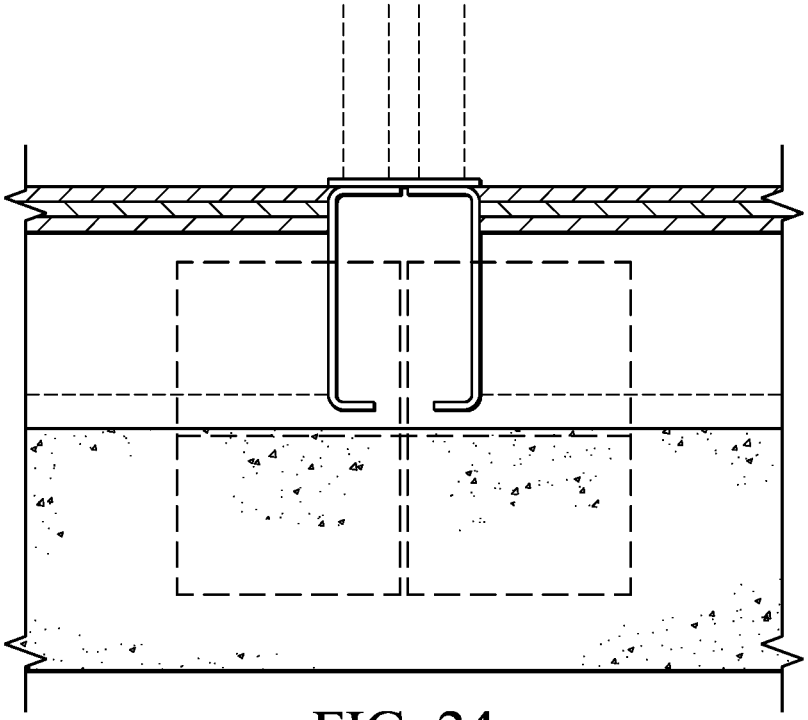
FIGS. 24-27 illustrate cross-sectional view of embodiments for four different types of transitions/gaps that may occur between LBMUs, that is, between two adjacent sides of LBMUs or two adjacent ends.
Figure 25:
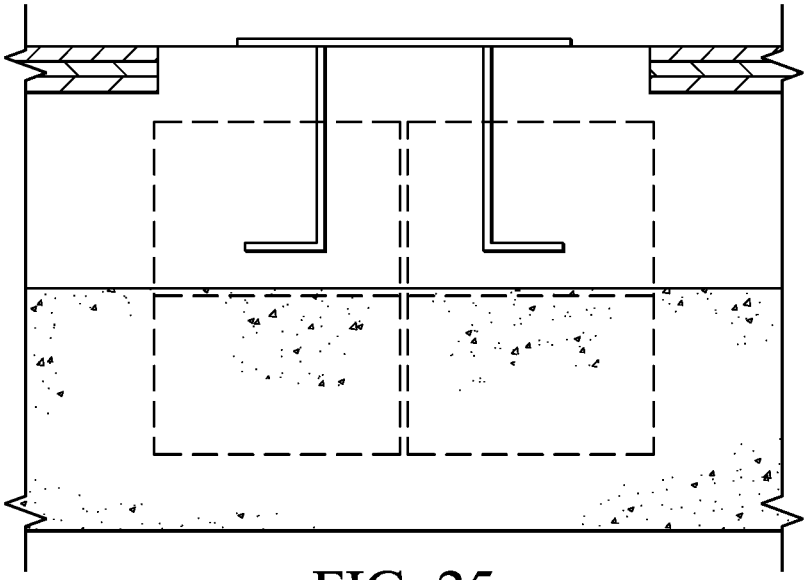
Figure 26:
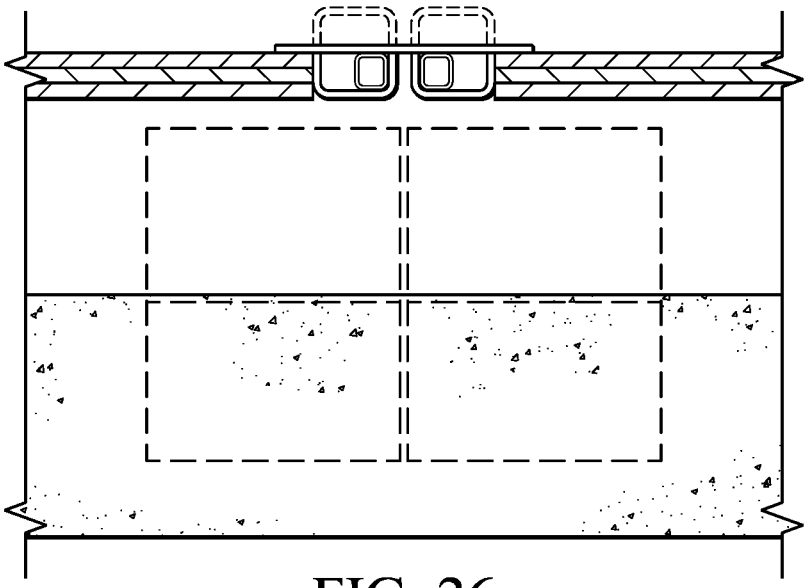
Figure 27:
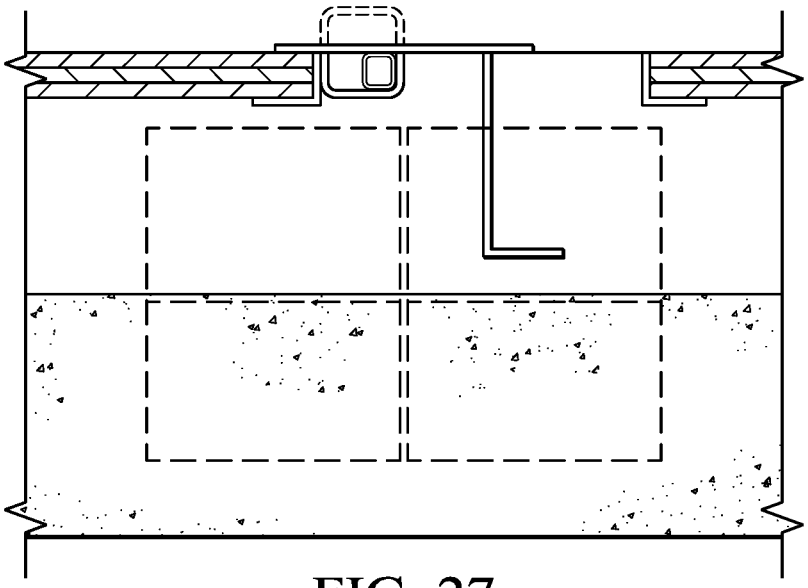

Given the corner block to corner block alignment (and possible horizontal and/or vertical welding therebetween) and side-to-side and end-to-end alignment of the LBMUs, then such passage would, without additional structure, involve a gap when passing between LBMUs. In preferred embodiments, therefore, also contemplated is a manner of transition between two LBMUs, that is across the gap between them. FIGS. 24-27, therefore, illustrate such embodiments, for the four different types of transitions/gaps that may occur, that is, between two adjacent sides of LBMUs or two adjacent ends, the latter depending on whether the ends are both rear ends (i.e., ends that included paired doors in OEM form), front ends (i.e., ends that are originally terminated by an endwall), or one end that is front and the other is rear. More specifically, FIG. 24 illustrates a side-to-side transition between two LBMUs, with vertical dashed lines indicating the nearby but cutaway corrugated side walls (to provide the passageway between the LBMUs) of the two LBMUs, and a metal plate atop (e.g., screwed), and spanning between, the upper surface of the side rail of the two LBMUs. FIG. 25 illustrates a front end-to-front end transition between two LBMUs, with a metal plate atop (e.g., screwed), and spanning between, the upper surface of the front end rail of the two LBMUs. FIG. 26 illustrates a rear end-to-rear end transition between two LBMUs, with the upper surface of the container bottom end rail cut away and a metal plate atop (e.g., screwed), and spanning between, the upper surface of the bottom end rail of the two LBMUs. Additionally, an HSS tube (shown cross-sectionally) is tack welded to the reminder (non-cutaway portion) of the bottom rail and provides vertical support the underside of the metal plate. FIG. 27 illustrates a rear end-to-front end transition between two LBMUs, with the upper surface of the container bottom end rail on one LBMU cut away and a metal plate atop (e.g., screwed), and spanning between the upper and cut away surface portion of the rear-oriented LBMU to the upper surface of the bottom rail of the front end of the other LBMU.

Figure 28A:
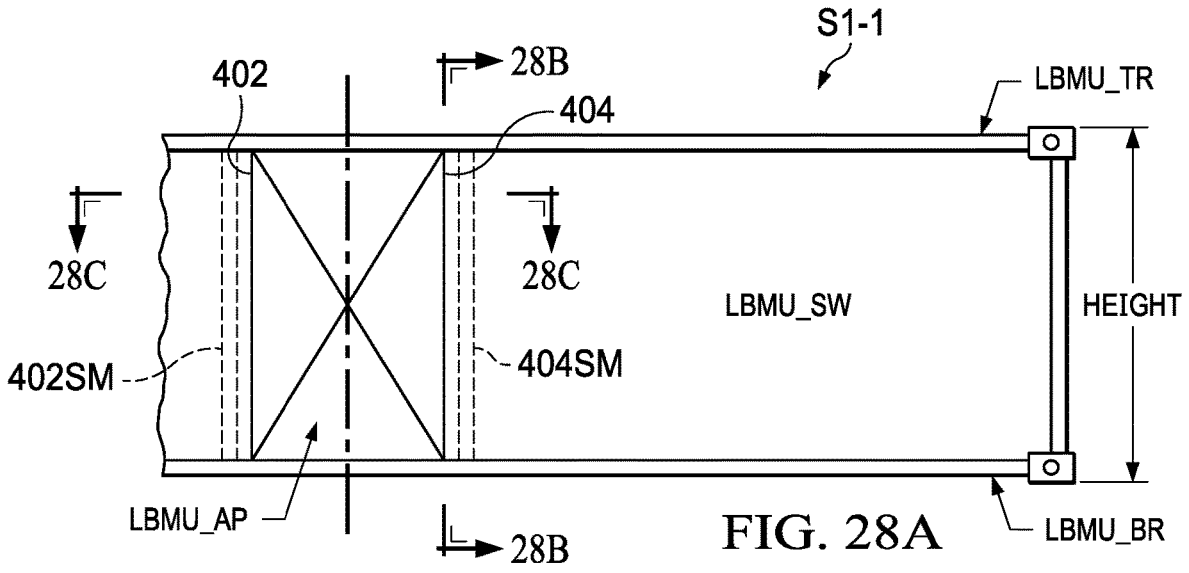
FIG. 28A illustrates a side view, and FIGS. 28B and 28C respective cross-sectional views, of an LBMU (e.g., LBMU S1-1), by way of an alternative example of how corridors may be formed with a single aperture (two vertical cuts)
Figure 28B:
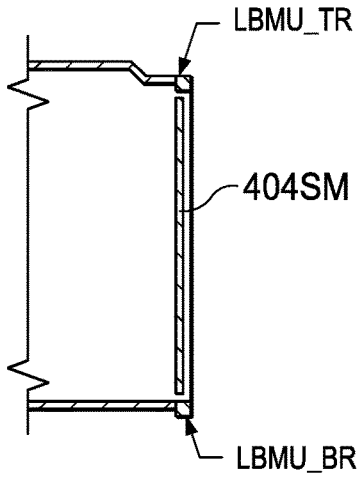
Figure 28C:
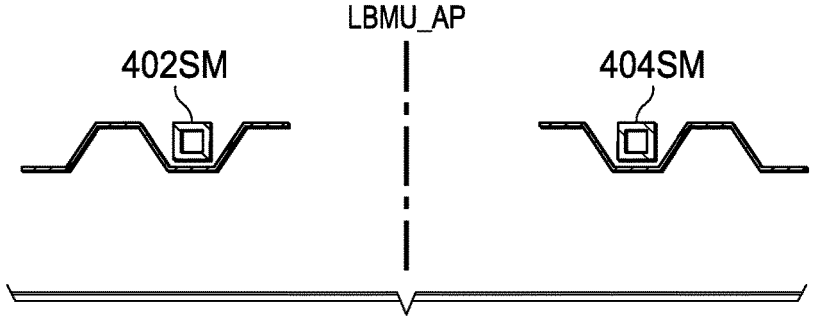

FIG. 28A illustrates a side view of an LBMU (e.g., LBMU S1-1), by way of an alternative example of how corridors may be formed. In FIG. 28A, two vertical cuts 402 and 404 are made in the LBMU sidewall LBMU_SW, with each of cuts 402 and 404 extending between the LBMU top rail LBMU_TR and the LBMU bottom ail LBMU_BR. Further, each of cuts 402 and 404 is equally spaced from a respective end of the LBMU. For example, for a nominally 40' long LBMU, each of cuts 402 and 404 may be approximately 17' from a respective LBMU end, thereby leaving 6' (i.e., 40'−(17'+17')=6') between cuts 402 and 404, that is, creating a 6' aperture LBMU_AP essentially centered, or within some variance (e.g., under two feet), along the LBMU sidewall LBMU_SW. Accordingly, a person may walk through that aperture LBMU_AP and through a like-positioned aperture on the opposing LBMU sidewall. FIGS. 28B and 28C illustrate respective cross-sectional views from the corresponding lines shown in FIG. 28A. As shown by vertical dashed lines in FIG. 28A, a vertical support member 402SM is positioned adjacent cut 402, and similarly a vertical support member 404SM is positioned adjacent cut 404. Each of vertical support members 402SM and 404SM is preferably formed by a hollowed steel section ("HSS") tubing, for example with square or rectangular cross-section (shown in FIG. 28C). In a preferred embodiment, each vertical support member 402SM and 404SM is welded into a fixed position parallel to the adjacent respective cut 402 and 404. For example, the vertical support members 402SM and 404SM may be tack welded in various locations to the LBMU sidewall, aligned in a peak or valley of the sidewall corrugation as shown in FIG. 28C. Further, as shown in FIG. 28B, the top of each vertical support member 402SM and 404SM is welded to the underside of the LBMU top rail LBMU_TR, and the bottom of each vertical support member 402SM and 404SM is welded to the top side of the LBMU bottom rail LBMU_BR.

It has been observed in connection with certain preferred embodiments that a centered aperture LBMU_AP as described above may provide numerous benefits, and may be used for a majority of the LBMU's in an entire facility that is constructed according to the teachings of this document. For example, such a facility may be constructed with 420 LBMUs, where the centering of an aperture as shown in FIG. 28A is implemented in over 95% of those LBMUs, and with stacking of the LBMUs as described above and also as in the as in the above-incorporated U.S. Pat. No. 10,280,608. By using centered cuts 402 and 404, possibly augmented with vertical support members 402SM and 404SM, each LBMU remains sufficiently strong in the vertical dimension so that multi-level LBMU stacking may still be achieved, particularly for example in the side-by-side orientation as shown in FIGS. 1-3. Thus, various of the additional vertical support implemented in other embodiments (e.g., FIGS. 13-14) or horizontal support (e.g., FIGS. 15B-15C) described above may be optional, modified, or eliminated, whereby instead vertical loads between stacked LBMUs can be provided solely by LBMU corner posts/corner blocks, and down to either a steel pile(s) or stem wall foundations. Accordingly, as long as the width of aperture (and resulting corridor when a same aperture is located on opposing LBMU sidewalls) does not exceed 6', then the addition of only one additional vertical support member one post near each cut edge may be the only reinforcement required to any LBMU of virtually all (or all) of the hundred or more LBMUs used to construct each facility level. Further advantages may include that: (i) no steel plates need to be added to the side walls of the LBMUs near the cut edges; (ii) no steel pieces are needed to connect the top and bottom rails of neighboring containers in order to transfer loads to grade at or near the vertical plane containing cut edges; (iii) no steel members are needed to support the bottom rails of the first floor LBMUs near the corridor cuts; (iv) all loads are transferred from all LBMUs through the corner posts and corner blocks to supporting foundations located at only the ends of the containers. Accordingly, there is no need to install supporting foundations at or near the corridor apertures. Further, the addition of the steel vertical support members near the cut edges facilitate the transfer of loads from near the middle of the containers to the corner posts/corner blocks. As a result of the preceding, this results in a much less expensive fabrication and construction project.

FIG. 29 illustrates a perspective view of a self-storage facility in accordance with the preceding, and with additional finish out including exterior walls, an exterior ceiling, and the like.

From the preceding, note that a remarkable self-storage facility may be constructed, using one or more of the various inventive attributes described herein. For example, a facility may be constructed with over 95% of its interior volume having internal walls and vertical load bearing support from LBMUs, arranged in rows of side-by-side LBMUs, with one or both ends of the LBMUs in end-to-end relationship with another row of side-by-side LBMUs. Each row can include dozens of LBMUs and a level can include two, or preferably three, it not more rows, all in the same side-by-side row, and at least one end-to-end configuration. Further, passage may be had between the facility LBMUs, in some instances from an end of a first LBMU into an end of a second LBMU, but in the majority of instances from a sidewall opening/passageway of a first LBMU into an opening/passageway of a second LBMU that is in side-by-side relationship to the first LBMU, and so on whereby lengthy corridors span transversely across the major axis of dozens of LBMUs. Such an approach standardizes or makes almost universally uniform the modification to each LBMU, thereby lowering cost, construction time, and chance of implementation error. Further, LBMU modification can be performed offsite, whereby the modified LBMU can be used at one of multiple different facility locations, to the extent that the various different facilities implement the above-described common attributes. Such flexibility allows large scale offsite partial fabrication, as well as accommodating the construction of multiple facilities at a time, whereby for example scheduling and material needs can be adapted from a same pool of modified LBMUs to serve the construction of multiple facilities. Still further, by standardizing the LBMU modification and making those LBMUs relocatable, it is potential that additional tax savings may be realized to the extent such LBMUs may have favorable tax depreciation realization. Still other benefits also will be appreciated by one skilled in the art given the present teachings, for example, features and benefits include:

- Longitudinal and/or transverse halls through LBMUs (e.g., shipping containers)
- LBMUs are positioned tight against one another in the horizontal planes and both vertical planes.
- LBMUs are connected to each other via welding adjoining container corner blocks.
- Penetrations are cut in the sidewalls and/or end walls of a series of LBMUs to create corridors to access self-storage units and other volumes in the facility such as longitudinal and transverse corridors, restrooms, utility rooms, elevators and stairs.
- Locating exactly one corridor penetration in the side of an LBMU at any of a variety of locations along its side creates two storage unit volumes in the LBMU. The magnitude of each volume is determined by the location and width of the penetration.

Locating exactly two corridor penetrations in the side of an LBMU at any of a variety of locations creates 3 or 4 storage unit volumes in one LBMU. The magnitude of each volume is determined by the locations and widths of the penetration.

Two corridor penetrations in the side of one LBMU provides four accesses into three volumes. A non load-bearing vertical partition constructed from any of a variety of materials (such as sheet metal, steel studs or lumber and panel construction) can be installed inside the middle volume of the three volumes, thereby creating a fourth volume. To be clear, the middle volume can be separated into 2 volumes. The partition is non load-bearing and can be relocated or removed entirely to create a variety of volume sizes.

LBMU corner blocks are the only components of one LBMU contacting another LBMU. Therefore LBMUs positioned side by side creating corridor(s) via penetrations in the LBMU sidewalls also results in a gaps between other container components, such as longitudinal bottom rails, longitudinal top rails and longitudinal side walls. These gaps are filled to prevent smoke migration (in case of fire) and to create a continuous floor.

Gaps between top rails and between side walls may be filled with a spray foam smoke barrier or other suitable barrier, then covered with sheet metal flashing or other aesthetically pleasing material.

Gaps between bottom rails may be filled with a spray foam smoke barrier or other suitable barrier, then covered with sheet metal fastened to the container floors. The floors may then be topped with a finished floor covering. If the sheet metal cover creates a bump in the floor, the bump will first be feathered (tapered) with a suitable floor filler/tapering material to meet ADA requirements, then topped with finished flooring.

Repositionable partitions inside storage areas.

When the rear end (door end) of an LBMU is installed facing the rear end of another LBMU so the LBMU's longitudinal axes are coincident, the doors of one containers can function as a repositionable partition.

Completely remove the doors from the rear of one LBMU. From the doors of the other LBMU, remove the gaskets, gasket keepers, locking rod pipes and appurtenances attached to the doors. There is no need to remove door locking attachments connected directly to the containers. Once this is accomplished, the doors are able to pivot about their hinge pins into the neighboring LBMU and are then pinned (e.g. screwed, bolted) in place, thereby creating the maximum volume possible by combining two smaller volumes into one larger volume. Alternately, the doors can be rotated into the normal (closed) position and then pinned (e.g. screwed, bolted) in place, thereby creating two smaller volumes.

Repositionable partitions can be pivoted quickly to create either 1 or 2 volumes, as needed.

LED strip lights illuminate halls and units.

LED strip lights adhere to the sides of the overhead tracks supporting the doors which allow entrance into a volume from corridors.

Install one or 2 strips of LED lights in the halls to illuminate the halls, storage units and other volumes once a door is opened. If more light is needed, adhere additional LED strip lights to the side of the overhead tracks supporting the doors.

Sprinkler piping

Main sprinkler piping (headers) may be mounted lengthwise in the halls, near the hall ceiling and suspended from the ceiling.

Sprinkler heads servicing the halls will be mounted on the headers.

A branch pipe (branch) will extend from the header to the inside of the storage unit or other volume (volume), ending almost immediately after entering the volume or ending after extending further into the volume. A side-spraying sprinkler head mounted on the end of the pipe provides water inside the storage unit, as required. A non side-spraying sprinkler header may also utilized instead of the side-spraying head.

Branches enter the storage unit through a void between the ceiling and the top of the door track. Because there are no obstructions in this void, layout, installation and mounting of the header and branch pipes is easier than more conventional installations.

Cable trays or similar supports installed near the hall ceiling organize and support power cables, signal cables and other cables required by the facility. These supports are attached to the ceiling between the ceiling and the sprinkler pipe.

Two corridor penetrations in the side of one LBMU provides four access points into three volumes. A non-load-bearing vertical partition constructed from any of a variety of materials (such as sheet metal, steel studs or lumber and panel construction) can be installed inside the middle volume of the three volumes, thereby creating a fourth volume. To be clear, the middle volume can be separated into 2 volumes. The partition is non-load-bearing (not a structural member of the building) and can be relocated or removed entirely to create a variety of volume combinations.

Doors, tracks and closures produced from readily available materials, including corrugated (or similar profile) sheet metal, square tubing, Unistrut or similarly manufactured strut components, Unistrut or similarly manufactured trolleys, and cylinder locks.

Further, while the inventive scope has been demonstrated by certain preferred embodiments, one skilled in the art will appreciate that it is further subject to various modifications, substitutions, or alterations, without departing from that inventive scope. For example, while certain apparatus and steps have been provided, alternatives may be selected. Thus, the inventive scope is demonstrated by the teachings herein and is further guided by the following exemplary but non-exhaustive claims.

What is claimed is:

1. A self-storage facility comprising:

a first set of load bearing modular units (LBMUs) aligned along a same first horizontal plane;

wherein the first set has a plurality of rows of LBMUs;

wherein each LBMU in each row in the plurality of rows of LBMU is positioned in a side-to-side relationship with another LBMU, in a corresponding row in the plurality of rows of LBMUs;

wherein each LBMU in each row in the plurality of rows of LBMUs is positioned in at least one end-to-end relationship with another LBMU in an adjacent row of a plurality of rows of LBMUs;

wherein each of the first set of LBMUs comprises four sidewalls;

a first passageway through a first sidewall and a second sidewall in a majority of the LBMUs in a first row in the plurality of rows of LBMUs, wherein the first passageway is transverse to a major axis of each LBMU in the first row;

a second passageway through a first sidewall and a second sidewall in a majority of the LBMUs in a second row in the plurality of rows of LBMUs, wherein the second passageway is transverse to a major axis of each LBMU in the second row; and a coupling passageway coupling the first passageway to the second passageway, the coupling passageway along a major axis of and through an interior of a first LBMU and a second LBMU, wherein the first LBMU and the second LBMU are positioned in an end-to-end relationship.

2. The facility of claim 1 wherein the first LBMU comprise a pair of pivoting doors extending along the coupling passageway into an interior of the second LMBU.

3. The facility of claim 1 wherein the first passageway is centered through the major axis of each LBMU in the majority of the LBMUs in the first row in the plurality of rows of LBMU.

4. The facility of claim 3 wherein the first passageway is a sole passageway transverse to the major axis of each LBMU in the majority of the LBMUs in the first row in the plurality of rows of LBMU.

5. The facility of claim 1 and further comprising:

a first door positioned along at least a portion of a first side of the first passageway where the first passageway passes through a major axis of an LBMU in the majority of the LBMUs in the first row in the plurality of rows of LBMU; and a second door positioned along at least a portion of a second side, opposing the first side, of the first passageway where the first passageway passes through a major axis of an LBMU in the majority of the LBMUs in the first row in the plurality of rows of LBMU.

6. The facility of claim 1 wherein the first door and the second door comprise roll-up doors.

7. The facility of claim 1 and further comprising, where for respective instances where the first passageway passes through a major axis of a respective LBMU in the majority of the LBMUs in the first row in the plurality of rows of LBMU:

a first door positioned along at least a portion of a first side of the first passageway where the first passageway passes through a major axis of the respective LBMU in the majority of the LBMUs in the first row in the plurality of rows of LBMU; and a second door positioned along at least a portion of a second side, opposing the first side, of the passageway where the first passageway passes through a major axis of the respective LBMU in the majority of the LBMUs in the first row in the plurality of rows of LBMU.

8. The facility of claim 7 wherein the first door and the second door comprise roll-up doors.

9. The facility of claim 1 and further comprising:

a second set of LBMUs aligned along a same second horizontal plane differing from the first horizontal plane;

wherein the second set has a plurality of row of LBMUs;

wherein each LBMU in each row in the plurality of rows of LBMUs of the second set is positioned in a side-to-side relationship with another LBMU in a corresponding row in the plurality of rows of LBMUs of the second set;

wherein each LBMU in each row in the plurality of rows of LBMUs of the second set is positioned in at least one end-to-end relationship with another LBMU in an adjacent row of a plurality of rows of LBMUs of the second set;

wherein each of the second set of LBMUs comprises four sidewalls;

a first passageway through a first sidewall and a second sidewall in a majority of the LBMUs in the first row in the plurality of rows of LBMUs of the second set, wherein the first passageway is transverse to a major axis of each LBMU in the first row; and a second passageway through a first sidewall and a second sidewall in a majority of the LBMUs in a second row in the plurality of rows of LBMUs of the second set, wherein the second passageway is transverse to a major axis of each LBMU in the second row.

10. The facility of claim 9 wherein each LBMU in the second set of LBMUs is physically in contact with a respective LBMU in the first set of LBMUs.

11. The facility of claim 9 wherein each LBMU in the second set of LBMUs has vertical load support by respective corner blocks of a respective LBMU in the first set of LBMUs.

12. The facility of claim 11 wherein each LBMU in the second set of LBMUs has vertical load support solely by respective corner blocks of a respective LBMU in the first set of LBMUs.

13. The facility of claim 9 and further comprising:

a third set of LBMUs aligned along a same third horizontal plane differing from the first and second horizontal planes;

wherein the third set had a plurality of rows of LBMUs;

wherein each LBMU in each row in the plurality of rows of LBMUs of the third set is positioned in a side-to-side relationship with another LBMU in a corresponding row in the plurality of rows of LBMUs of the third set;

wherein each LBMU in each row in the plurality of rows of LBMUs of the third set is positioned in at least one end-to-end relationship with another LBMU in an adjacent row of a plurality of rows of LBMUs of the third set;

wherein each of the third set of LBMUs comprises four sidewalls;

a first passageway through a first sidewall and a second sidewall in a majority of the LBMUs in a first row in the plurality of rows of LBMUs of the third set, wherein the first passageway is transverse to a major axis of each LBMU in the first row; and a second passageway through a first sidewall and a second sidewall in a majority of the LBMUs in a second row in the plurality of rows of LBMUs of the third set, wherein the second passageway is transverse to a major axis of each LBMU in the second row.

14. The facility of claim 12:

wherein each LBMU in the second set of LBMUs is physically in contact with a respective LBMU in the first set of LBMUs; and wherein each LBMU in the third set of LBMUs is physically in contact with a respective LBMU in the second set of LBMUs.

15. The facility of claim 14:

wherein each LBMU in the second set of LBMUs has vertical load support by respective corner blocks of a respective LBMU in the first set of LBMUs; and wherein each LBMU in the third set of LBMUs has vertical load support by respective corner blocks of a respective LBMU in the second set of LBMUs.

16. The facility of claim 13 wherein each of the first set of LBMUs, second set of LBMUs, and third set of LBMUs includes at least 10 LBMUs.

17. The facility of claim 13 wherein each of the first set of LBMUs, second set of LBMUs, and third set of LBMUs included at least 20 LBMUs.

18. The facility of claim 13:

wherein a first edge of the first passageway in the first row in the plurality of rows of LBMUs of the first set is vertically aligned with a second edge of the first passageway in the first row in the plurality of rows of LBMUs of the second set;

wherein the second edge of the first passageway in the first row in the plurality of rows of LBMUs of the second set is vertically aligned with a third edge of the first passageway in the first row in the plurality of rows of LBMUs of the third set; and further comprising vertical support structure aligned vertically relative to the first edge, the second edge, and the third edge, and between the first horizontal plane and the second horizontal plane and the third horizontal plane.

19. The facility of claim 1 wherein each of the LBMUs comprises a commercial shipping container.

* * * * *